US005870657A

United States Patent [19]

Nagame et al.

[11] Patent Number: 5,870,657

[45] Date of Patent: Feb. 9, 1999

[54] CHARGING APPARATUS FOR PHOTOCONDUCTOR WITH OZONE ADSORPTION FEATURES

[75] Inventors: Hiroshi Nagame; Narihito Kojima; Hiroshi Ikuno, all of Numazu, Japan

[73] Assignee: Ricoh Company, Ltd., Tokyo, Japan

[21] Appl. No.: 817,823

[22] PCT Filed: Sep. 5, 1996

[86] PCT No.: PCT/JP96/02525

§ 371 Date: Aug. 7, 1997

§ 102(e) Date: Aug. 7, 1997

[30] Foreign Application Priority Data

| | | | |
|---|---|---|---|
| Sep. 5, 1995 | [JP] | Japan | 7-250088 |
| Oct. 24, 1995 | [JP] | Japan | 7-298853 |
| Nov. 27, 1995 | [JP] | Japan | 7-331100 |
| May 13, 1996 | [JP] | Japan | 8-142247 |

[51] Int. Cl.[6] ..... G03G 15/02

[52] U.S. Cl. ..... 399/174; 361/225

[58] Field of Search ..... 399/91, 93, 98, 399/168, 170, 174, 176, 175; 361/221, 225; 350/324–326

[56] References Cited

FOREIGN PATENT DOCUMENTS 3-9380 1/1991 Japan .

*Primary Examiner*—S. Lee

*Attorney, Agent, or Firm*—Oblon, Spivak, McClelland, Maier & Neustadt, P.C.

[57] ABSTRACT

A charging apparatus for a photoconductor composed of an electroconductive charging member and mechanism for feeding a voltage to the charging member. This charging apparatus is composed of a material capable of adsorbing ozone. The charging apparatus may be in the form of a roller type, a blade type or the like. Carbon fibers having micro pores can be used as the charging member.

15 Claims, 17 Drawing Sheets

CHARGING APPARATUS FOR PHOTOCONDUCTOR WITH OZONE ADSORPTION FEATURES

TECHNICAL FIELD

The present invention relates to a charging apparatus for uniformly charging an image bearing member, namely, a photoconductor.

BACKGROUND ART

In a copying machine using an electrophotographic system, and an image formation apparatus such as a laser printer, a corona discharger is in general use for charging an image bearing member, that is, a photoconductor, for performing image transfer, for separating copy paper, or for quenching charges of the photoconductor, since uniform charging can be performed by the corona charger.

However, since a high voltage as high as 4000 to 8000 V is applied to the corona discharger, a large amount of ozone ($O_3$) is generated by the corona discharger when discharging is carried out. Effects of ozone on living body system are described in detail in an article entitled "Troubles caused by corona discharging and techniques for preventing the troubles" (Electrophotography 30.3/1991) by Yasuyuki Tabata. Nitrogen oxides (Nox) which are generated at the same time as the generation of ozone are also considered to work as factors by which the quality of produced images is degraded and the life of the photoconductor is shortened, since such nitrogen oxides are deposited on the surface of the photoconductor or penetrate into the photoconductor.

In particular, nitrogen oxides (Nox=NO, $NO_2$, $NO_3$, . . . ) react with water in air to produce nitric acid ($HNO_3$) which is deposited not only on the photoconductor, but also on and around the charging apparatus itself, and corrodes metallic materials used in the charging apparatus. As a result, the characteristics of the photoconductor are caused to deteriorate (refer to Japanese Laid-Open Patent Applications 61-12358, 62-7065 and 2-79069). Therefore, as countermeasures for controlling the generation of corona products from the corona discharger, many proposals have been reported, such as locally providing an ozone absorbing material on a shield wall for the discharger, providing an ozone decomposing material in vicinity with the photoconductor, and heating the discharger. However, currently such proposals cannot always sufficiently cope with the above-mentioned problems, since those proposals have problems with respect to the continuity of the effect, the cost, or the capability of completely nullifying ozone products. Under such circumstances, in recent years, there have been made studies as to how to make practically usable contact charging methods (such as roller charging method and brush charging method) which are considered to be methods with an extremely small amount of generation of ozone, and such a method has already actually been put to practical use in some copying machines.

FIG. 17 shows an outline of a conventional corona charger. In the figure, reference number 1 indicates a photoconductor; 50, a shield case; 51, a charge wire; and 52, a grid. Contact charging apparatus are shown in FIG. 18 to FIG. 20. FIG. 18 shows a brush contact charging apparatus. In the figure, reference numeral 53 indicates an electroconductive brush. FIG. 19 shows a blade contact charging apparatus. In the figure, reference numeral 54 indicates a core material, and 55 indicates an electroconductive unwoven cloth. Furthermore, FIG. 20 shows a roller contact charging apparatus. In the figure, reference numeral 56 indicates a resistor layer, and 57 indicates a surface protective layer. In the charging apparatus shown in FIG. 18 and FIG. 19, there are generally used electroconductive fibers which are carbonized to such a degree that the resistance thereof is, for instance, in the range of about $10^3$ to $10^6$ Ω; and in the charging apparatus shown in FIG. 20, there is generally used an electroconductive rubber roller with the resistance thereof being adjusted to about $10^5$ Ω·cm by uniformly dispersing carbon powder in the rubber.

The corona discharger generates ozone in an amount of about 1 to 10 ppm, and nitrogen oxides (Nox) such as $NO_2$ and $NO_3$ in an amount of about 0.05 to 0.5 ppm immediately below a charger thereof in a copying machine with a copy speed of about 10 to 40 cpm, provided that the amounts of such products generated change depending upon the copy speed. In the contact charging method (for instance, using the roller charging apparatus), 1500 to 2000 V, which is about ¼ the voltage applied in the corona discharging method, is applied to the roller charging apparatus, so that the amount of ozone generated in the contact charging method is extremely small in the range of 0.02 to 0.5 ppm, and the amounts of nitrogen oxides (Nox) are also as small as about 0.03 to 0.05 ppm.

Thus, the contact charging method is directed to the improvement with respect to the above-mentioned problem.

However, the amounts of the above-mentioned corona products are not zero, so that the corona products are gradually accumulated and deposited on an image bearing member. In the case of an organic photoconductor without a protective layer, the surface is scraped off, so that the deposited products can be relatively easily removed and therefore the effects of such products on the organic photoconductor are small. However, when the organic photoconductor is used for an extended period of time, the contamination of the photoconductor with the corona products gradually spreads into a photoconductive layer thereof with time, and eventually the deterioration of image quality is brought about. When the photoconductor is coated with a protective layer with high hardness from which contamination products are difficult to remove, such as a DLC film (diamond-like carbon film), a period of time free of problems can be significantly extended in comparison with such time as in the corona discharging method. However, when the photoconductor is exposed to corona products for a long period of time, image quality deterioration such as image flow tends to take place easily. Such contamination takes place more or less even when the hardness of the OPC layer is increased.

Each of Japanese Laid-Open Patent Applications 6-274007 to 274009 discloses the use of an electroconductive unwoven cloth ($10^5$ to $10^7$ Ω/cm$^2$) as a contact member which comes into contact with the photoconductor. When fibers such as acrylic fibers and pitch fibers are burned at high temperatures, such fibers are carbonized and become electroconductive and therefore can be used as materials for a contact charging member. The resistance value thereof varies depending upon the burning temperature. However, when the contact charging member is in the shape of an unwoven cloth, even if the contact charging member comes into contact with the image bearing member, there is no risk that deep scratches are formed in the image bearing member, since the contact member is an unwoven cloth made of extremely thin fibers, just like a felt. However, the ends of the fibers are bare and such fibers that can be used in the charging apparatus are thin, with a small fiber diameter, because of the necessity for the uniformity in the thickness of the fibers. Therefore such fibers tend to be easily pulverized, and pulverized fibers are deposited around the charging apparatus, causing abnormal discharging, and when such powder enters a cleaning section or a development section, the photoconductor and a cleaning blade are scratched, so that troubles such as lowering image quality, for instance, due to resolution reduction or improper image transfer, tend to be caused.

Japanese Laid-Open Patent Application 7-5745 discloses a contact charging apparatus which is in the shape of a band or a roller made of an electroconductive resin film which is prepared by dispersing electroconductive fibers with a water absorption of 0.2% or less in a resin.

Japanese Patent Publication 6-75221 discloses the use of a locally carbonized polyacrylonitrile fiber (with a tip portion thereof being treated so as to have a resistance of $10^2$ to $10^6$ Ω·cm) in a contact portion with a photoconductor.

As mentioned above, the electric resistance of the fibers depends upon the burning temperature of the fibers, that is, there is the tendency that the higher the burning temperature, the lower the electric resistance. Therefore, the resistance can be obtained as desired by appropriately adjusting the burning temperature. However, the fibers tend to become brittle as the burning temperature is increased.

A charging member used in the above-mentioned conventional art is composed of carbon fibers with an electroconductivity set in a certain range, and therefore ozone and nitrogen oxides which are generated at the time of charging cannot be absorbed on the carbon fibers themselves.

Therefore it is an object of the present invention to provide a charging member having a function of removing contamination materials such as ozone and nitrogen oxides with high efficiency and capable of preventing the deterioration of the characteristics of the image bearing member and maintaining stable image quality over an extended period of time, and to provide a charging apparatus using the above-mentioned charging member.

DISCLOSURE OF THE INVENTION

The present invention provides an electroconductive charging member and an apparatus for charging a photoconductor, which includes means for applying voltage to the electroconductive charging member, with the electroconductive charging member being capable of adsorbing ozone.

The present invention will now be explained in detail with reference to the following accompanying drawings.

Figure 1:
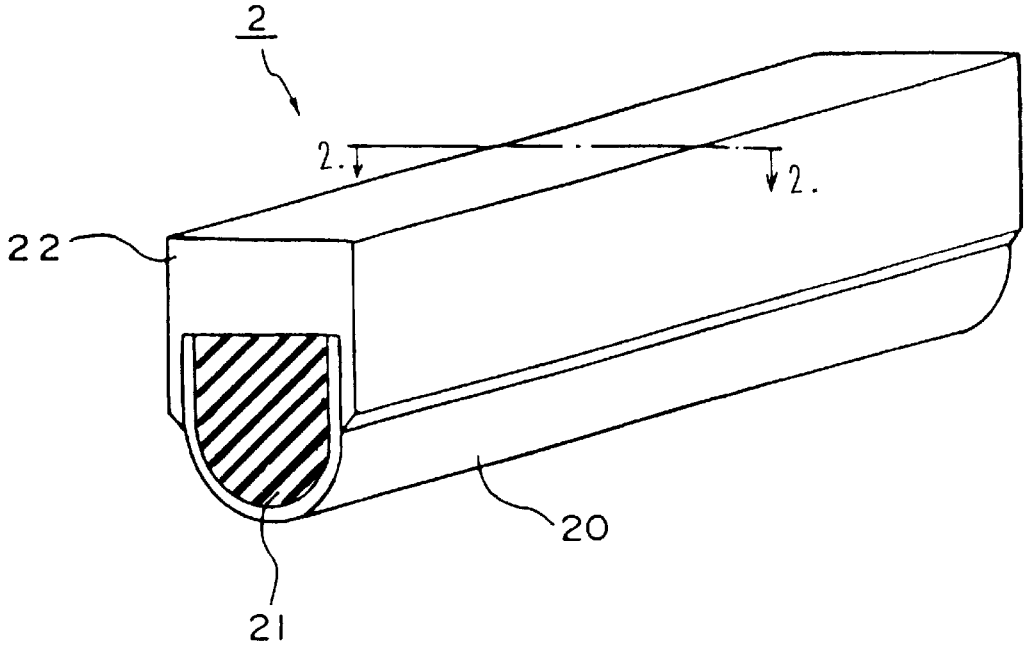
FIG. 1 is a schematic perspective view of a blade charging apparatus of the present invention.

The terms "inorganic fibers" in Example 11 and "sheets" means as follows:

Inorganic fibers

Artificial fibers made from inorganic compounds, such as silicate fiber, metallic fiber, carbon fibers. These fibers are used in the forms of felt, unwoven fabric, and woven fabric, or in the form of finely-divided powder, which is dispersed in a matrix, such as resin, cellulose or rubber, when necessary, with the addition of other materials thereto, for example, a fluorine-based polymer for improvement of frictional resistance and resistance to climate. Structured fibers can be used in the shape of a sheet or with direct application thereof to a roll shaft, or can be worked into the shape of a roller.

Sheets

Thin plates, such as a sheet of paper, a charging member or an electroconductive plate, with a thickness of about 2 to 3 mm, which can be used by cutting with an appropriate width. It is preferable that a sheet-shaped charging member be backed with a reinforcement member, such as a polyethylene terephthalate film, a polyimide film, or an acetate film, with a thickness of 50 to 200 μm.

It is considered that almost the same materials (such ions and compounds) are produced when an image bearing member, that is, a photoconductor, is charged by either a contact method or a non-contact method. Produced ion species are, for example, $CO_3^-$, $O^-$, $O_2^-$, $O_3^-$, $NO_2^-$, $NO_3^-$, $OH^-$, $H^+$, $NO^+$, and $NO_2^+$, and produced compounds are, for example, $HNO_3$, and $NH_3NO_3$, provided that the amounts of the above-mentioned products produced by the contact charging method is as small as about 1/10 to 1/100 the amounts of the products produced by the corona discharge method.

In particular, ozone and nitrogen oxides work as main factors for causing the photoconductor to deteriorate, so that it is necessary to use as the material for the charging member a material having such structure that does not hinder the charging function of the charging member, and has a function of adsorbing ions and compounds of the ozone and nitrogen oxides, or a catalytic function of decomposing such ions and compounds and removing the same. Examples of adsorbing/catalytic materials for ozone are silica gel, active zirconia, zeolite, active alumina, activated carbon, active carbon fiber, and Ti—Si—Zr based oxides, titanium dioxide—aluminic acid lime—manganese oxide based materials, Cu—Mn based materials, alumina—silica gel based materials, and terpenoid. Examples of adsorbing/catalytic materials for nitrogen oxides are activated carbon, titanium dioxide—aluminic acid lime—manganese oxide based materials, calcium hydroxide—activated carbon—calcium carbonate based materials, and Pt—$Al_2O_3$ materials.

Most of these materials are solid, and can be used alone. However, they can be used not only alone, but can be used in combination of two or more materials under predetermined conditions or when necessary. The charging member of the present invention can be used for both the contact charging apparatus and the non-contact charging apparatus, but can be advantageously used for the contact charging apparatus. The case where the charging member of the present invention is used in the contact charging apparatus will now be explained in detail.

The contact charging apparatus may be, for example, roll-shaped, brush-shaped, or blade-shaped. The charging member of the present invention can be used in any shape of the contact charging apparatus. For example, a roll-shaped charging member can be fabricated by pulverizing the above-mentioned adsorption/catalytic material, kneading the pulverized adsorption/catalytic material together with electroconductive finely-divided particles, for instance, in rubber. A representative example of a carbon fiber to which an adsorption function is imparted is active carbon fiber. This fiber is not only effective for removing both ozone and nitrogen oxides, but also electroconductive and can be used alone and can be worked when necessary, so that the carbon fiber is one of preferable materials for use in the present invention.

Ordinary carbon fibers having no adsorption function have a diameter of 10 $\mu$m to 100 $\mu$m are used in portions which require high strength, for instance, in aircrafts and rockets, or for fire proofing clothes which must be resistant to fire, or in sport goods.

Carbon fibers having the adsorption function for use in the present invention, a representative example of which is an active carbon fiber, can be prepared by subjecting microfibers with a diameter of 5 to 15 $\mu$m, such as polyacrylonitrile (PAN) fiber $[C_3NH_3)_n]$, cellulose fibers $[(C_6H_{10}O_5)_n]$, phenolic resin $[(C_{63}H_{55}O_{11})_n]$ fibers, and pitch based $[(C_{124}H_{80}NO)_n]$ fibers, to flame-resistant treatment at about 200° to 500° C. to make the fibers electroconductive. The thus treated carbon fibers, however, have almost no adsorbing characteristics, but are ordinary carbon fibers. The thus carbonized fibers are then heated to 600° to 1000° C. in an atmosphere of an activation gas such as carbon dioxide and activated, so that micro pores with a radius of about 10 to 40 Å are formed in the walls of the fibers. The presence of such micro pores has a close relationship with the adsorption function of the fibers. Since the diameter of the micro pores is suitable for the size of molecules to be adsorbed, the thus prepared carbon fibers have better adsorption characteristics than adsorption materials having numerous micro pores, such as activated carbon. When the diameter of the micro pores of the carbon fibers is as large as about 100 Å, the diameter is much large than the molecular diameter of nitrogen oxides, so that the adsorption performance of carbon fibers having such micro pores is lowered.

Carbon fibers having such adsorption function are mostly composed of carbon (about 90% or more), and other components therefor are a small amount of hydrogen or nitrogen, and the balance is an ash.

The above-mentioned removal function is performed by molecules of chemical compounds entering the above-mentioned micro pores and being adsorbed therein, or being decomposed therein, that is, by the adsorption and decomposition functions of the micro pores. This adsorption function is effective for adsorbing NOx, SOx, ozone, toluene gas, mercaptan, chlorine, ammonium, hydrogen sulfide, and methyl sulfide. These characteristics are much better than those of conventional deodorizers such as activated carbon, for instance, obtained from coconut shell. The adsorption characteristics of such fibers are generally improved as the specific surface ($m^2/g$) thereof is increased. However, the absorption characteristics also depend upon the size of the molecules of the compound to be adsorbed, so that it could occur that the above relationship is reversed.

Carbon fibers having a representative adsorption function can be prepared from 4 to 5 kinds of fibers, such as the above-mentioned cellulose fibers and phenolic resin fibers as the starting material thereof. Of such carbon fibers, carbon fibers prepared from polyacrylonitrile based fibers (PAN based fibers) contain about 2 to 5% of N. Practically there is a correlation between the weight % of nitrogen to carbon, that is, N/C, and the adsorption characteristics of NOx. When N/C is in the range of 0.3 to 0.7 (wt. %) or more, there can be observed a tendency that the NOx adsorption characteristics are improved. From this fact, it is considered that the nitrogen atom contributes to the adsorption of NOx. More specifically, the polyacrylo-nitrile (PAN) based fibers which contain nitrogen atoms exhibit better adsorption and decomposition characteristics with respect to NOx and others which are produced at the time of charging than the cellulose based or phenol resin based fibers which are free of nitrogen atoms, and have greater mechanical strength, so that it is particularly effective to use the polyacrylo-nitrile (PAN) based fibers for the charging member for the image bearing member.

Carbon fibers which are most preferable with respect to the ozone adsorption characteristics and mechanical strength are such polyacrylonitrile based fibers that have an ozone saturated adsorption amount in the range of 4.0 to 7.0%. The ozone saturated adsorption amount can be determined from the following formula by placing a sample fiber layer with a layer thickness of 3 mm in a cylindrical sample chamber with a gas flow cross section of 70.5 $mm^2$, and causing an inert gas containing ozone with a concentration of 3 ppm to pass through the sample fiber layer at a flow rate of 0.5 m/sec for a period of 50 to 120 minutes under the conditions that the temperature is 25° C. and the humidity is 50%:

$$SA=(W_1-W_0)/W_0\times 100(\%)$$

where SA is the ozone saturated adsorption amount (wt. %), $W_0$ is the weight of the sample before the above measurement, and $W_1$ is the weight of the sample after the ozone-containing gas has been caused to pass through the sample in a saturated state.

Carbon fibers having such adsorption function are commercially available in the forms of a felt, a tow, a fabric, and an unwoven fabric. Such carbon fibers can be used alone, but can also be used by pulverizing the fibers with a fiber length of about 100 μm or less, uniformly dispersing the pulverized fibers in paper, resin or rubber, and working the dispersion into the shape of a sheet or a roll.

Figure 20:
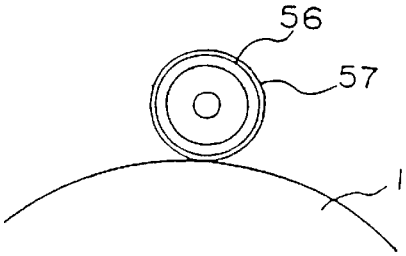
FIG. 20 PRIOR ART
FIG. 20 is a diagram of a roller contact charging apparatus.

A charging member comprising as the main component the adsorption function imparted carbon fiber or carbon fiber is a resistor with low resistance, so that when the charging member is brought into contact with a dielectric member, and the contact point thereof is changed as the dielectric member or the charging member is rotated under the application of a voltage thereto, electric charges can be imparted to the dielectric member, that is, the dielectric member can be charged, in accordance with Pashen's law by the charging member with excellent linearity. Furthermore, this charging member has low electric resistance and therefore has excellent environmental stability. However, when the active carbon fiber is used in a slide contact charging apparatus, such charge injection that does not follow Pashen's law takes place, the charging characteristics are improved by about 100 to 150 V than calculated, so that the voltage to be applied may be set lower by about 150 to 250 V than in the case of the roller contact charging apparatus as shown in FIG. 20.

From the above, it can be said that when the active carbon fiber is used in the charging member, stable chargeability can be obtained. However, since the charging member using the active carbon fiber has a low electric resistance, the charging member has the risk that the charging member is damaged or the charging characteristics thereof is made unstable when the charging member is directly connected to a power source and there is a scraped off portion in the photoconductor, and a rush current flows and short-circuit with the power source takes place. This risk can be avoided by connecting a resistor between the power source and the charging member (or the charging apparatus). As the resistor, a conventional solid resistor can be sufficiently used. Other than such a solid resistor, for instance, there can be of course employed a resistor such as an organic electroconductive film or an electroconductive rubber sheet in which, for instance, carbon is dispersed.

The carbon fibers having the adsorption characteristics are composed of fibers, with individual fibers being as thin as 5 to 15 μm, carbonized and therefore brittle, so that when the fibers are fabricated in such a form that the top ends of the fibers come into contact with the photoconductor over many points thereof, for instance, in the form of an unwoven fabric or a felt, the top end portion of each fiber is easily broken or worn to form finely-divided fiber particles. The thus formed finely-divided fiber particles have adverse effects on the charging stability of the charging member or on the images to be formed, or form scratches on the photoconductor, or may wear the photoconductor. Therefore, it is preferable to use the carbon fibers in a suitable form for the object of the application or to work the carbon fibers into a suitable form.

Of various application forms of the carbon fibers, when the carbon fiber is used in a blade contact charging method, it is preferable to use the carbon fibers in the form of a fabric with possibly finest interstices, with an elastic member being used therein, which has excellent durability, is capable of sufficiently securing close contact with the image bearing member, and has such hardness that does not form scratches on the image bearing member and does not give mechanical damage to the image bearing member, whereby the wearing of the image bearing member can be reduced, and there can be obtained substantially the same image quality as the image quality that can be obtained by the corona charging method. To be more specific, it is preferable that the fibers be worked into a fabric and the fabric be used as a stationary charging member without rotating the same as in a roller charging member.

However, when the fibers are used in the form of the fabric, there is a tendency that image S/N depends upon charging uniformity which depends upon the size of the interstices of the fabric. This problem can be solved by using a fabric with a minimum size of interstices, holding the fabric stationarily at least during the charging thereof, bringing the fabric into contact with the image bearing member with a contact width of 1 to 8 mm, preferably with a contact width of 2 to 6 mm for charging operation, whereby images with excellent S/N ratio can be obtained without the interstices being made visible. When the interstices are too large or the contact width is insufficient, striped patterns or imbricate patterns are formed in the images in the peripheral direction thereof, or it becomes necessary to apply a charging potential more than necessary to gain a sufficient S/N ratio, which may cause the risk of bringing about discharge breaking in the image bearing member.

When the carbon fibers in the form of a fabric is used in the roller charging method, images free of background toner deposition can be obtained, but chargeability is exhibited along the textures of the fabric, but non-uniform charging is apt to take place, and therefore, the use of the carbon fiber fabric in the roller charging method is not suitable for obtaining high image quality. The image quality obtained by this method can be improved to some extent by changing the rotation speed of the charging member.

The carbon fibers can be used in the roller charging method by working into a roll a composite material in which finely-divided carbon fiber particles are uniformly dispersed in a matrix such as an acrylic material or a fluorine-based material or a variety of rubber materials. Such a roll can be prepared by winding a sheet-shaped charging member spirally directly or via an elastic member around a roll. When the sheet-shaped charging member is actually wound around the roll, it is preferable that the surface of the roll or the surface of the elastic member be subjected to slippage prevention treatment. For example, it is preferable that the roll surface be treated so as to have a surface roughness of 150 to 1000 meshes, or the roll surface be subjected to adhesion treatment for preventing the slippage. The same thing also applies to the case where the roll is covered with the elastic member.

The charging member for use in practice has a film thickness of about 0.1 to 5 mm and a hardness up to about 85 degree. It is preferable that the hardness be in the range of about 60 to 10 degrees. When a charging member with a hardness of about 70 to 80 degrees is used, an elastic member is also used in combination with the charging member in order to gain a contact width of about 2 to 8 mm. The hardness of the elastic member is 25 degree or less, preferably 10 degree or less. When the elastic member is used in combination with the charging member, it is preferable that the elastic member be integrated with the charging member, using an adhesive agent, in order to prevent the slippage between the two. When there is a slippage between the elastic member and the charging member, black bands or insufficiently charged portions may be formed.

The charging member can be directly worked into a roller by winding a resin sheet with a thickness of about 0.05 to 0.2 mm, in which finely-divided carbon fiber particles are dispersed, around a roller, and softening the resin sheet at about 130° to 200° C. to integrate the resin sheet with a roll core metal; or by winding around a core metal a fused resin in which finely-divided active carbon fiber particles are dispersed under the application of heat thereto.

There is a method of adjusting the surface roughness as desired while heating the resin to its softening point. The hardness should be in the range of about 60 to 10 degree.

Electric charges in the charging member move in accordance with Paschen's law. Therefore when the surface of the charging member is not uniform, the surface potential of the image bearing member, namely the photoconductor, is non-uniform with large ripples, so that obtained image quality tends to be lowered. It is necessary that the surface of the charging roller be as uniform as possible, desirably with a surface roughness of 15 $\mu$m or less. The smaller the surface roughness, the more advantageous for obtaining better charging stability and images with uniform quality.

The case where the charging member of the present invention is used in the roller charging apparatus will now be explained in more detail.

There should not occur the case where the charging member scratches the photoconductor, so that the charging member must be made of fine particles pulverized to such a degree that the photoconductor is not scratched by the pulverized particles of the charging member, and the adsorption performance of the charging member should not be lost by use of such finely pulverized particles. It is the inorganic fibers that satisfy the above requirements. Activated carbon has the same effects as mentioned above, but the pores in activated carbon tend to be broken in the course of the pulverizing process, and therefore the adsorption performance tends to be lost. Furthermore, activated carbon has high hardness, so that when activated carbon particles are dispersed in the charging member, high is the risk that the photoconductor is scratched by the dispersed activated carbon particles. The inorganic fibers for use in the present invention have an extremely thin fiber diameter of 5 to 15 $\mu$m. Therefore the object of the present invention can be achieved by finely dividing the fibers with an appropriate length and dispersing the finely-divided fibers in a necessary amount in a binder resin.

The amount of the inorganic fibers to be dispersed in the charging member is 60 to 90% with respect to the resin, preferably 65 to 85% with respect to the resin. When the dispersion amount is reduced to less than 60%, in particular, to 40%, the electric resistance of the charging member is $10^{11}$ Ω·cm or more, the charging characteristics and the uniformity of images are lowered. When the dispersion amount is reduced to less than 60%, the charging member cannot adsorb the corona products and cannot achieve the object of removing the corona products. On the other hand, when the dispersion amount is 85% or more, in particular, when the dispersion amount exceeds 90%, charging becomes imbalanced due to the excess inorganic fibers, so that imbricate charging patterns are apt to appear and the uniformity of images tend to be further worsened.

The inorganic fibers (preferably carbon fibers) are originally long fibers before the fibers are dispersed in the charging member. Therefore, the fibers are pulverized so as to have an appropriate length for dispersing the same in the resin. When the fibers are too long, uniform charging performance is lost and the ripples of the charging potential become great, so that images tend to become considerably non-uniform. Therefore, it is necessary to pulverize the fibers to the extent by which the adsorption performance is not impaired and to disperse in the resin the fibers pulverized to such extent. The length of the dispersed fibers is 120 $\mu$m or less, preferably 60 $\mu$m or less. However, when the fibers which are pulverized to too short a length are dispersed in the charging member, the pulverized fiber particles are apt to be dropped, and the adsorption function are lost. Therefore, it is necessary that the fibers have a length of at least 5 $\mu$m or more, and it is preferable that the fibers have a length of 30 to 5 $\mu$m.

The charging member is fabricated in such a manner that the above-mentioned inorganic fibers are uniformly dispersed in a binder resin. However, when the inorganic fibers are covered with the binder resin to produce such a state that micro pores that contribute to the provision of the adsorption function are covered by the binder resin, the adsorption function is lowered and eventually the proper adsorption function is lost. Therefore, it is necessary that the inorganic fibers be exposed without being covered by the resin on the top surface of the charging member which comes into contact with the photoconductor. Furthermore, in order to maintain the adsorption function continuously, it is preferable to use such a binder resin that permits easy penetration of generated gases therethrough. Furthermore, it is preferable to use such a resin that does not have adverse effects on the photoconductor. From this point of view, acrylic resin is usually used as the binder resin, provided that resins other than acrylic resin can also be employed as long as the resins are capable of continuously maintaining the function of the charging member and having no adverse effects on the photoconductor. Examples of the resins are such resins as having high tensile strength, such as fluorine plastics, rubber resin, and polyester resin.

Acrylic resin, when cured, has an extremely high hardness of 95 degree or more, measured by a hardness meter in accordance with the Japanese Industrial Standards, JIS-K6301, so that when the inorganic fiber is dispersed in an amount of 90% in the acrylic resin, the hardness thereof is about 70 to 75 degree, and when the inorganic fiber is dispersed in an amount of 60% in the acrylic resin, the hardness thereof is about 80 to 90 degree. However, this hardness is too great for use in the charging apparatus in view of the fact that a preferable hardness for the charging apparatus is about 50 degree, so that it is preferable to replace the acrylic resin with a material having a lower hardness, or to insert an elastic member between the core material or metal, in order to secure the contact of the charging member with the photoconductor. It is preferable that the elastic member have a hardness of 29 degree or less, more preferably a hardness of 25 degree or less, as measured by the harness meter. An example of such an elastic member is an expanded polyurethane resin based material.

There are a brush type, a roller type and a blade type as the types of the charging apparatus. In any type of the charging apparatus, electric charges in the charging member move in the same manner in accordance with Pashen's law when the charging member comes to the image bearing member with a certain distance therebetween, so that when the contact of the charging member with the image bearing member is not uniform, the surface potential considerably varies with great potential ripples, so that image quality tends to be lowered. In such a case, there is caused the inconvenience that the charging potential has to be increased to a value more than necessary, in order to improve the S/N.

The above-mentioned carbon fibers in the form of a fabric are suitable for use in the blade charging apparatus, while the composite material in which the finely-divided carbon fiber particles are dispersed is suitable for use in the roller charging apparatus.

The blade charging method is of a stationary type, and the carbon fibers in the form of a fabric themselves are soft and have greater durability than that of a felt or an unwoven fabric, so that when the fabric is used in combination with a core member with an appropriate elasticity, the contact thereof with the image bearing member is improved, and the contact width thereof can also maintained appropriately and therefore in comparison with the roller charging type, the effects of the surface roughness of the charging member and of materials deposited on the image bearing member tend to become smaller. Even so, it is preferable to choose a fabric of carbon fibers with possibly finest interstices in order to obtain images with high quality.

In the case of the roller type, the roller charging member is rotated, so that the roller charging member is apt to be affected by foreign materials deposited on the image bearing member or projections formed on the image bearing member and therefore, it is necessary that the roller have uniform surface as much as possible. As mentioned above, the smaller the surface roughness, the more advantageous for attaining the stability of charging potential and for obtaining images with uniform quality. It is preferable that the surface roughness be 15 $\mu$m or less.

In order to carry out the uniform charging, the setting of the contact width is also important. Normally, the contact width is secured in the range of about 1 to 8 mm. It is preferable that the contact width be in the range of about 2 to 6 mm, and there will be no problem when the contact width is set in this range. This contact width can be applied to both the blade charging method and the roller charging method.

As a core material for the blade charging apparatus, or as an elastic sheet material for use as an elastic coating layer such as a sheet-shaped carbon fiber dispersed resin, a material with a hardness of 29 degree or less, as measured by a hardmeter in accordance with the Japanese Industrial Standards JIS-K6301, is normally used. It is preferable that the hardness of such a material be 25 degree or less, more preferably 15 degree or less. This is for securing the contact of the charging member with the image bearing material and for setting an appropriate contact width. The contact width is set in the range of 2 to 8 mm in order to obtain uniform images. As the material for such member, soft plastics material, soft rubbers such as urethane and chloroprene rubbers, foams such as urethane foam, felt, natural or synthetic cotton, fur products and paper products can be used.

With respect to the electric resistance of the charging members, members with a surface resistance of about 10 to $10^{5}$ $\Omega/cm^2$ and a volume resistivity of about $10^2$ to $10^6$ $\Omega\cdot cm$ can be employed.

The surface resistance of the carbon fibers in the form of a fabric is as extremely low as about 10 to $10^2$ $\Omega/cm^2$. On the other hand, the resistance of the system composed of the carbon fibers dispersed in the resin varies depending upon the dispersion ratio of the carbon fibers as mentioned above. The carbon fibers are dispersed in the resin with a maximum ratio of about 90 and several percent. As the dispersed amount of the carbon fibers is increased, the adsorption characteristics are improved, but the surface smoothness tends to decrease. When the carbon fibers are dispersed in an amount of about 90% in the resin, a significant amount of the carbon fibers is deposited except on the resin, but it does not constitute any substantial practical problem.

When the carbon fibers are dispersed in an amount of 90% in the resin, the dispersed composite has a surface resistance in the order of $10^4$ to $10^5$ $\Omega/cm^2$, and a volume resistivity in the order of $10^3$ to $10^4$ $\Omega\cdot cm$. When a charging member with such a low resistivity is used, for instance, a problem of breaking a power supply source can be avoided in the course of charging the image bearing member even if the photoconductor has a problem of, for example, including a damaged portion therein, by inserting a protective resistor between the charging member and the power supply source. However, when the photoconductor includes a peeled-off portion by which image defects are made visible, a black band may be formed in the portion corresponding to the peeled-off portion. However, there will no problem even if there are such pin holes in the photoconductor that do not make image defects visible.

Carbon fibers that can be fabricated into a sheet have to have such properties that the fibers can be dispersed in a resin such as acrylic resin, or fluorine plastics, or in a variety of rubbers, maintain elasticity and are free from adhesiveness after being cured. When the sheet is used alone, it is preferable that the sheet after molding have a hardness of about 10 to 60 degree to gain a necessary contact width. However, when the sheet is used in combination with an elastic member, the hardness of the sheet may be about 85 degree for use in practice.

FIG. 1 shows a diagram of a blade charging apparatus. In a blade charging apparatus 2, a charging member 20 comprising carbon fibers in the form of a fabric having the adsorption function includes a core material 21 therein, and is held in an insulating holder 22 in such a manner as to come into contact with an image bearing member (photoconductor).

When as the core material 21, rubber or plastics is used, the charging member 20 may be elastically brought into contact with the image bearing member, using a spring member, with the application thereto of such a load that can stationarily hold the image bearing member. In order to secure the contact width and also to improve the contacting performance, it is preferable to use as the material for the core material 21 such an elastic material that does not break the charging member 20, for example, soft plastics, soft rubbers such as urethane and chloroprene, urethane foam, felt, natural or synthetic cotton, fur products, and paper products. Foams with restoration properties and elasticity, and soft materials such as unwoven fabric of synthetic cotton are particularly preferable.

The charging member 20 is a fabric with a thickness of about 0.2 to 1 mm and used by being folded into two to third. When the charging member 20 is used without being folded, uneven charging may occur because of the elongation of the charging member 20 when set.

Figure 2:
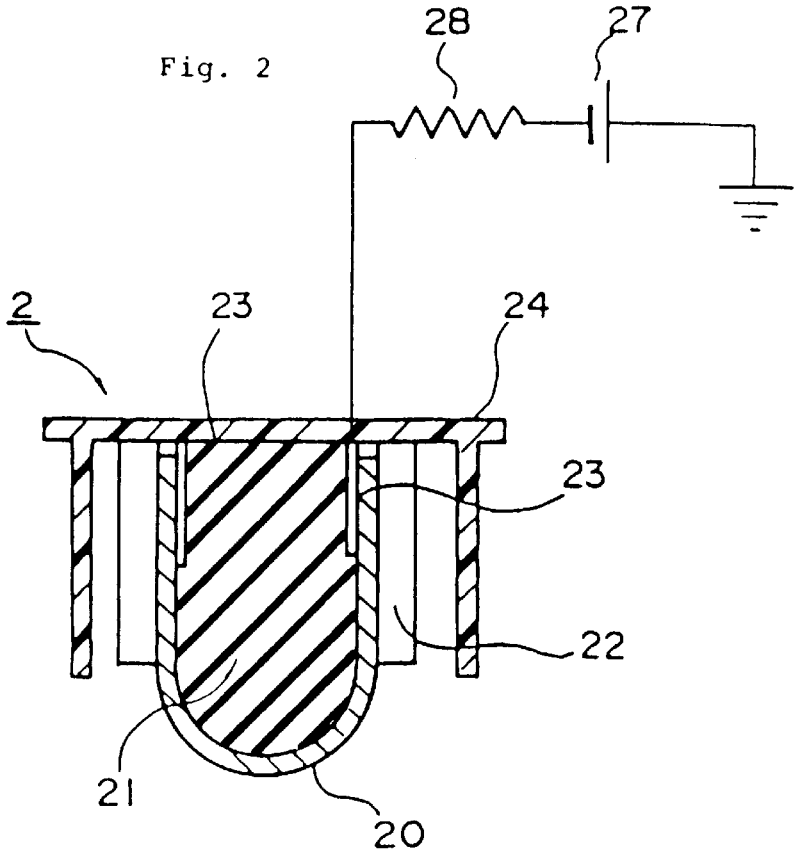
FIG. 2 is a cross-sectional view of the charging apparatus taken on line II—II in FIG. 1.

FIG. 2 is a cross-sectional view of the charging apparatus 2, taken on line II—II in FIG. 1. An electrode 23 provided on the charging member 20 is connected to a voltage feed source 27 to feed a voltage (±1000 to 2000V) for charging the photoconductor. The electrode 23 is provided on the outside of the elastic member 21 so as to be in contact with the charging member 20 with a width of about 1 mm or more over the entire length thereof. As the material for the electrode, a copper foil tape, an aluminum foil or tape, a stainless steel foil or tape. Reference number 24 in FIG. 24 indicates a shield case made of a metal or plastics.

Figure 3:
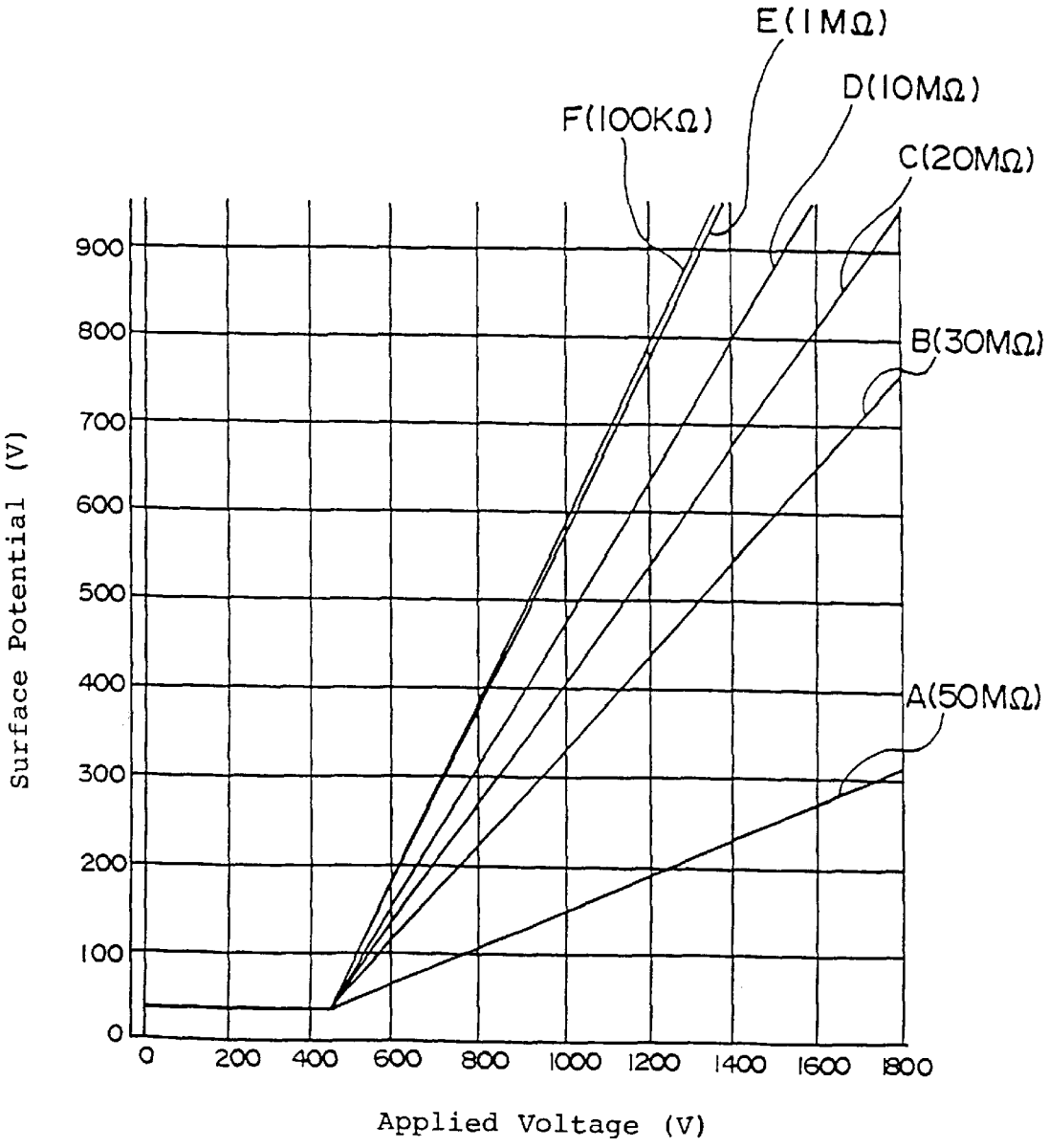
FIG. 3 is a charging characteristics diagram of the charging apparatus in Example 1.

A resistor 28 is connected to the charging member 20. This is necessary for preventing the breaking of the voltage feed power source connected to the charging member 20 and for securing the stability of the charging potential. The resistance of the resistor 28 connected to the charging member 20 varies depending upon the surface resistance of the charging member 20. In the case of a charging member with a surface resistance of about 100Ω, the resistance varies as shown in FIG. 3. In FIG. 3, line A indicates the case where the resistor connected to the charging member 20 has a resistance of 50 MΩ, line B indicates the case where the resistor has a resistance of 30 MΩ, line C indicates the case where the resistor has a resistance of 20 MΩ, line D indicates the case where the resistor has a resistance of 10 MΩ, line E indicates the case where the resistor has a resistance of 1 MΩ, and line F indicates the case where the resistor has a resistance of 100 KΩ. As can be understood from the graph in FIG. 3, the value of the current which flows into the charging member 20 varies by connecting the resistor to the charging member 20, and as the resistance value is increased, the surface potential of the image bearing member (photoconductor) is lowered. When the value of the protective resistance is set at 50 MΩ or more, it is necessary to apply a voltage of 2000 V or more in order to obtain the desired charging potential, but in such a case, the life of the charging member is apt to be shortened and image noise is also apt to be generated due to the generation of ozone, and therefore, the above-mentioned setting is not suitable for use in practice.

Therefore, as shown in FIG. 3, the resistance value of the connected resistor has to be 50 MΩ or less. In the case where the charging member 20 comprising the carbon fibers in the form of a fabric, which has a surface resistance of about 100 Ω, it is necessary to interpose a resistor with a resistance of more than 10 KΩ to 100 KΩ.

When a resistor with a resistance of 10 KΩ or less is connected, the charging becomes unstable as shown in the following TABLE 1, and when part of the photoconductor is peeled off, it is possible that the power source becomes inferior. Normally, there will be no problem when a resistor with a resistance of about 1 MΩ is connected. When a resistor with a smaller resistance value within the above-mentioned range is connected, the applied voltage can be reduced. Even when the resistance value is reduced, ripples do not increase.

The surface resistance of the charging member discussed here means the value of the resistance that can be measured when 5 V is applied across a pair of copper electrodes with a contact area of 2 mm×2 cm, with a space of 1 cm therebetween.

TABLE 1

| Protective Resistance | Stability of Power Source | Charging Performance |
|---|---|---|
| 1 kΩ | No good | No good |
| 10 kΩ | No good | No good |
| 100 kΩ | Good | Good |
| 1 MΩ | Good | Good |
| 10 MΩ | Good | Good |
| 30 MΩ | Good | Good |
| 50 MΩ | Good | No good |

The charging apparatus can also be used for other purposes, such as image transfer, sheet separation and charge quenching. The charging apparatus is used, for instance, by being integrated with a shield case or the like and being set in an image formation apparatus.

When a fabric of the carbon fibers is used, frays are apt to be formed at the cross-section thereof. When such frays are locally in contact with the photoconductor, cut-off fibers enter a cleaning section and cause improper cleaning and charging and the formation of abnormal images.

When the charging apparatus is used for a short period of time, there will be no problems if the cross-section is sufficiently protected by a holder. However, when the charging apparatus is used for a long period of time, it is preferable that some countermeasure for preventing the formation of the frays be made in view of the safety. Such countermeasure is effective for facilitating uniform setting of the charging member. FIGS. 4 to 7 show specific examples of such countermeasures.

Figure 4:
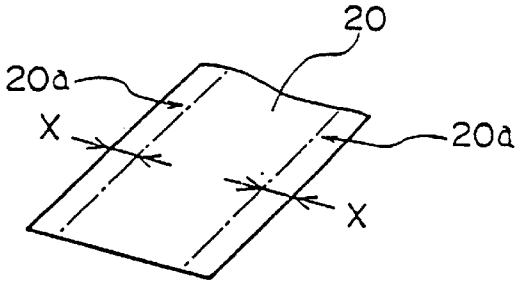
FIG. 4 is a partial perspective view of a charging member made so as not to be frayed.

FIG. 4 is a partial perspective view of the charging member 20 before the member is attached to a holder 3. On each of the opposite edge portions of the charging member 20, there may be provided a fray-preventing portion 20*a* with a width of X mm made of vinyl resin, epoxy resin, or other resin which is cured by the application of heat or ultraviolet light thereto, and/or a metal plate or a resin plate which can be fixed by contact bonding, or a material for hand-stamping, or by a hand-stamping method. It is preferable that the fray-preventing portion 20*a* have a width of X, wherein X=1 mm or more, in order to attain effective fray prevention. Generally, it is preferable that X be 2 to 5 mm (X=2 to 5 mm). When the resin plate or the like is fixed, using an adhesive agent, it is necessary to use an adhesive agent with a certain viscosity or more. An adhesive agent with a low viscosity, such as cyanoethylate, is not preferable because it spreads and penetrates into the charging member.

Figure 5:
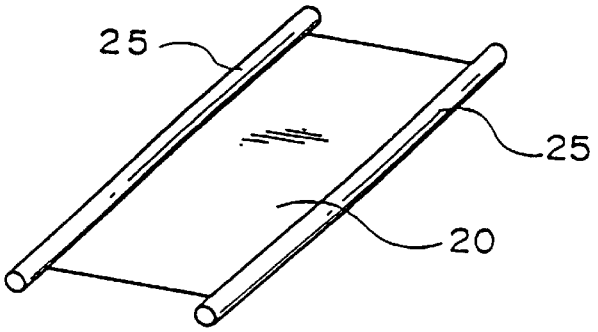
FIG. 5 is a partial perspective view of a charging member made so as not to be frayed in another way different from the above.
Figure 6:
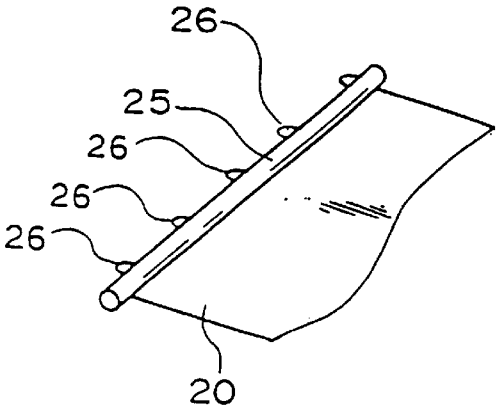
FIG. 6 is a partial perspective view of a charging member which is modified from the charging member shown in FIG. 5.
Figure 7:
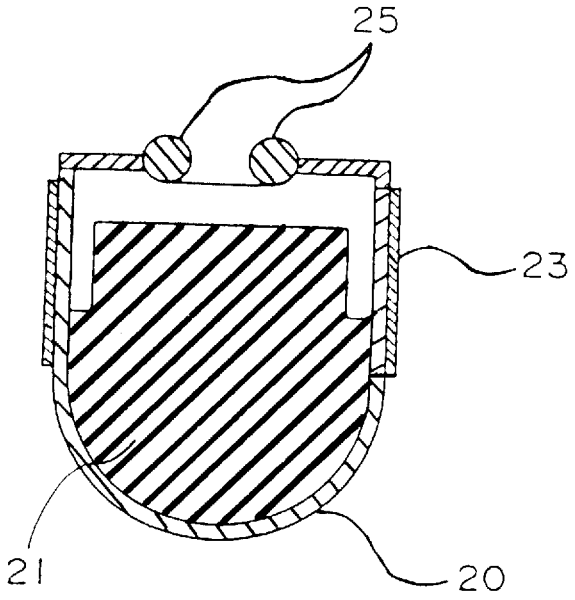
FIG. 7 is a cross-sectional view of an attachment structure for the charging member shown in FIG. 5, which cross-sectional view is similar to that shown in FIG. 2.

A fixing member may be provided on the charging member 20. Such a fixing member may be composed of rods 25 provided along the opposite edge portions of the charging member 20 as illustrated in FIG. 5. The rod 25 may be, for example, a rod made of vinyl chloride resin with a diameter of about 1.0 to 1.5 mm, a stainless steel rod, an aluminum rod, or other suitable members, if any. As shown in FIG. 6, a plurality of hooks may be provided on the rod 25. The provision of such a fixing member on the charging member 20 facilitates the replacement of the charging member 20 and is advantageous in view of the maintenance thereof. FIG. 7 shows an example of an charging apparatus 1 which is incorporated in an image formation apparatus, with the fixing members 25 for the charging member 20 being fixed on part of a supporting member.

Figure 8:
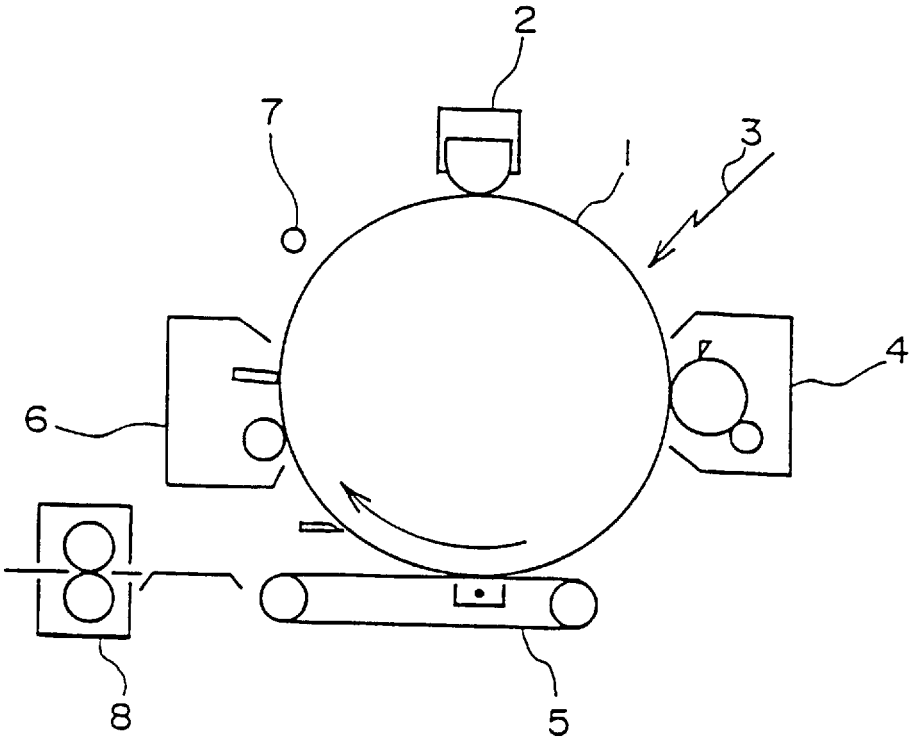
FIG. 8 is a diagram of an image formation apparatus in which an charging apparatus shown of Example 1 is set.

FIG. 8 is a diagram of a charging apparatus which is actually installed. In the case of a negative charging type organic photoconductor, a voltage of −1200 to −1600 V is applied to a blade charging apparatus 2 via a resistor, and the image bearing member (photoconductor) is charged to a potential of −600 to −1200 V which is necessary for image formation. In FIG. 8, reference numeral 3 indicates an exposure section (optical system); reference numeral 4, a development section; 5, an image transfer section; 6, a cleaning section; 7, a charge quenching section; and 8, an image fixing section.

Figure 10:
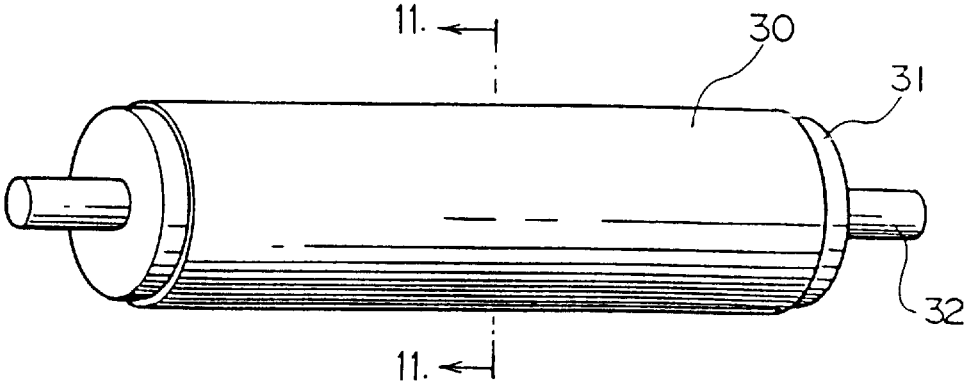
FIG. 10 is a perspective view of a roller portion of a roller charging apparatus according to the present invention.
Figure 11:
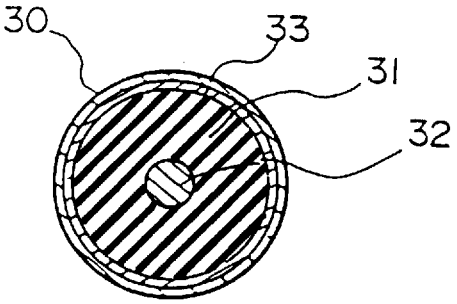
FIG. 11 is a cross-sectional view taken on line III—III in FIG. 10.

FIG. 10 shows an outline view (perspective view) of a roller-shaped charging apparatus (charging roller section), and FIG. 11 shows a cross-sectional view thereof, taken on line III—III in FIG. 10. In FIG. 10, reference numeral 32 indicates a roller shaft; 31, a main body; 33, an elastic overcoat layer (elastic member); 30, a charging member, which is a composite member in which carbon fibers having an adsorption function are uniformly dispersed. It is not always necessary that the opposite end portions of the roller shaft 32 be made of the same material. It is required that a voltage-applied side of the roller shaft 32 be good electroconductive and have abrasive resistance. Therefore, as the material for the voltage-applied side of the roller shaft 32, metals having high hardness, such as titanium alloy, beryllium alloy, and stainless steel are preferable for use. For instance, brass may also be used if a contact method is devised therefor, although the hardness thereof is lower than the above-mentioned metals.

As the roller main body 31, almost any member can be used as long as it is made of a material which is not thermally deformed, is easy to work and is not be corroded, and has such weight that makes it possible to maintain contact with the image bearing member (photoconductor) and to perform uniform charging. As a matter of course, the roller main body 31 may be integrated with the roller shaft. Only for the roller main body, materials such as aluminum, brass, stainless steel, chromium- or tin-plated iron, resins such as Derlin, carbon materials and plastics members can be employed. When a sheet in which carbon fibers are uniformly dispersed is directly coated on a roller to form a roll, it is preferable that the surface of the roller be treated so as to prevent the slippage or turning over of the sheet. This can be done, for instance, by a method of working the surface of the roller so as to have a surface roughness of 150 to 1000 meshes, or a method of extremely thinly coating or spraying an adhesive sheet, an urethane foam with high coefficient of friction, a gel-like material or a paste-like materia on the surface of the roller. In this case, no uniformity is particularly required. The roller main body 31 may be a vacant cylinder. Such a cylinder may be constructed in such a manner that holes with a diameter of 0.5 to 2 mm are formed on the entire surface of the cylinder to suck contaminants effectively and to allow exhaustion.

As the material for the elastic member 33, for instance, soft plastics, soft rubbers such as urethane, chloroprene, urethane foam, felt, synthetic leather (with or without raising) can be employed. It is preferable that the elastic member 33 be wound around the roller 31 in a spiral way, since no differences in level are formed. When the elastic member 33 has a film thickness of about 2 mm, the member can be wound around directly on the roller without any problems, but when the elastic member 33 is thicker than that, the difference in level is apt to be formed in the border portions of the sheet, so that when a band-shaped cut sheet is used, it is preferable to use a sheet with the cut surface thereof being inclined with a degree of about 30 to 60. it is also possible to wind the sheet so as to be superimposed to form two- or three-stacking.

When an overcoat layer such as the elastic member is interposed between the charging member 30 and the roller 31, electric conduction between the charging member 30 and the roller shaft 32 is performed, using an electroconductive sheet, such as a copper foil tape or stainless steel tape.

The charging member 30, which is a composite member in which carbon fibers are uniformly dispersed, is a sheet or a roll with the surface thereof being made smooth, prepared by pulverizing carbon fibers with a fiber diameter of several $\mu$m to carbon fibers with a fiber length of about 10 to 60 $\mu$m, dispersing the thus pulverized carbon fibers in polyester resin, acrylic resin, fluorine plastics, rubber, or cellulose, which can maintain its elasticity after being cured, in such a manner that the dispersion has a uniform resistance, while maintaining the adsorption effect. The hardness of the charging member 30 is set at about 10 to 85 degree (when the charging member is used alone, it is preferable that the hardness thereof be about 10 to 60 degree) and that the softness thereof be such that the charging member 30 comes into surface contact with the image bearing member (photoconductor) 1, whereby the image bearing member (photoconductor) 1 can be uniformly charged. When the charging member 30 is in the form of a sheet, it is preferable that the thickness thereof be about 0.1 to 3 mm. The charging member 30 with a thickness of about 1 mm can be wound as it is, but it is preferable that a thicker charging member be spirally wound in the same manner as in the case of the above-mentioned elastic member 33, with the cut surface thereof being inclined with a degree of about 30 to 60, whereby the formation of abnormal images, such as images with strips, can be prevented.

When the charging member 30 is used alone, the charging member 30 with a surface resistance of $1\times10^2$ to $1\times10^7$ ($\Omega$) and a volume resistance of $1\times10^2$ to $1\times10^6$ ($\Omega\cdot$cm) is used, since the carbon fibers are dispersed in the above-mentioned resin or the like. When the resistance of the charging member 30 is increased, a predetermined charging potential cannot be obtained unless a high voltage is applied thereto, it is unreasonable to use a charging member with high resistance. (In the above, the lower values of the resistances correspond to the values of the resistances of the carbon fibers.)

When a voltage is applied, the charging member is used via a resistor corresponding to the above-mentioned resistances. When a resistor with a resistance of about 1 M$\Omega$ is connected thereto, normally there is no problem.

When a voltage is directly applied, there is the risk that the power source is broken due to short-circuit when the resistance of the charging member 30 is too low, so that care must be taken. The adsorption function can be maintained by having the powder of the carbon fibers slightly appear on the surface of the sheet (with the dispersion amount of the carbon fibers being set, for example, at about 90% with respect to the resin), whereby the effect of eliminating ozone and nitrogen oxides is made good. The ratio of the resin to the pulverized active carbon fibers is normally set, with the characteristics thereof such as mechanical characteristics, surface characteristics and electric resistance taken into consideration.

Figure 12:
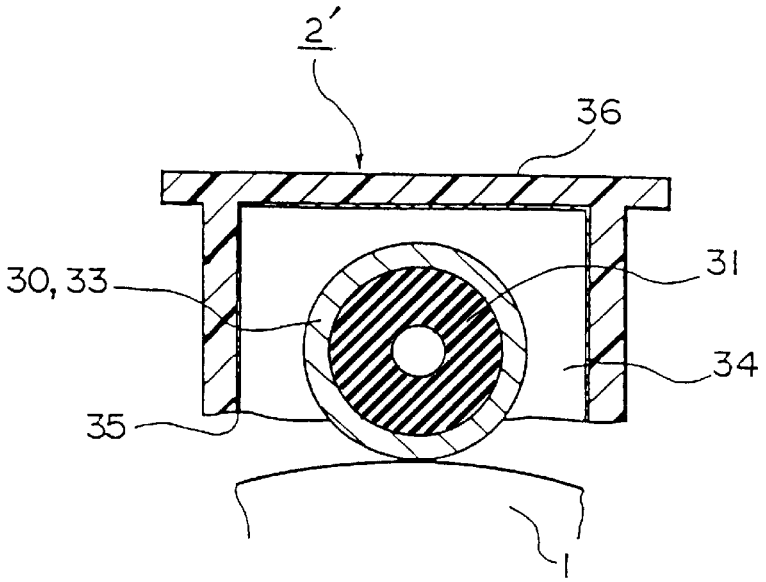
FIG. 12 is a partial cross-sectional view of a roller charging apparatus according to the present invention.
Figure 13:
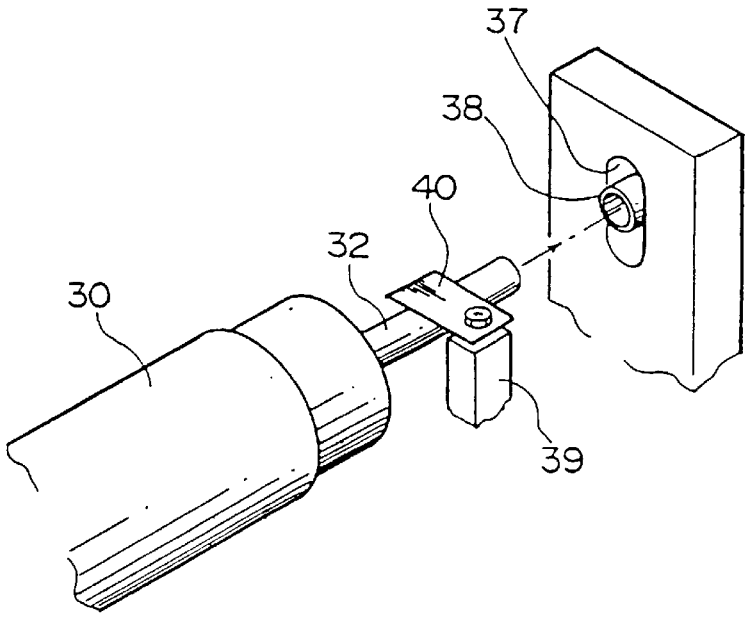
FIG. 13 is a diagram in explanation of a roller supporting method in the charging apparatus shown in FIG. 12.
Figure 14:
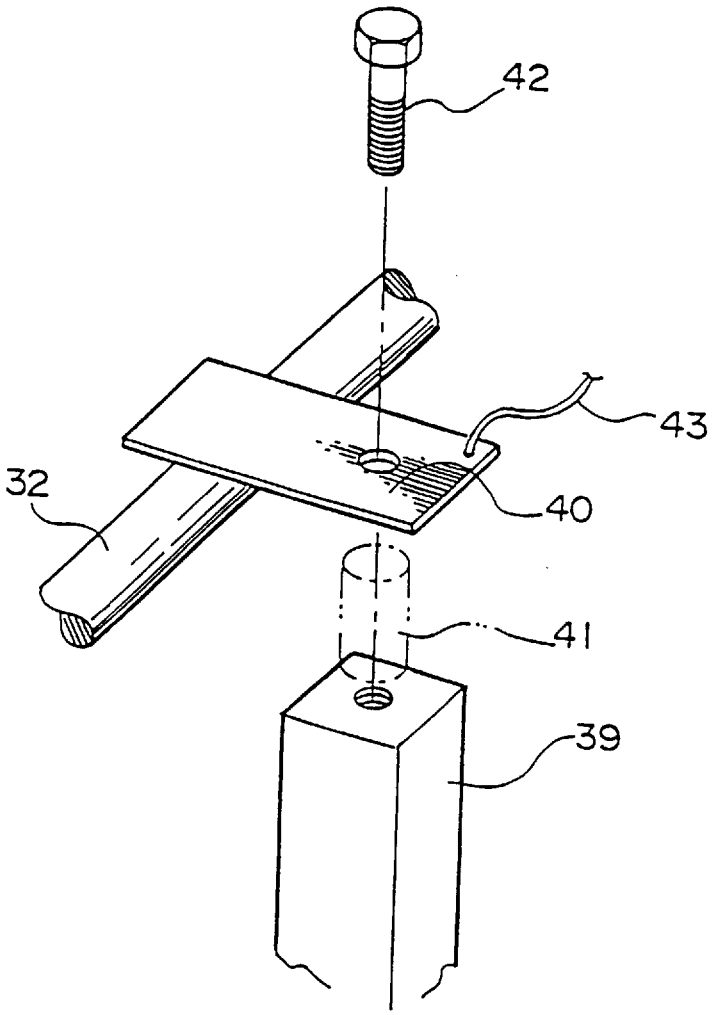
FIG. 14 is an exploded view of a voltage application portion for a roller shaft in the charging apparatus shown in FIG. 12.

FIG. 12 is a cross-sectional view of a charging apparatus 2', which is built in a shield case 36. A shield material 35, such as polyethylene terephthalate (PET), is applied to the inside of the shield case 36, provided that when the shield case 36 is made of an insulating material, the shield material 35 is unnecessary. FIG. 13 and FIG. 14 are respectively a diagram in explanation of a supporting method for a drugging roller with the image bearing member (photoconductor) and an exploded view of a portion for applying voltage to the roller shaft 32. A bearing 38 is set at the roller shaft 32. The bearing 38 is set in a long hole 37 of an end block 34 which is worked so as to be movable in a detachable direction from the image bearing member (photoconductor) 1. An electrode 40 is in contact with part of the shaft 32 to which a voltage is externally applied, and also in such light contact with a support block 39 that even when the charging roller is rotated at high speed, electric conduction is sufficiently secured, via a repulsion member 41 (fixed with a screw 42) having a spring effect. A lead wire 43 is connected to the electrode 40, and is also connected to a resistor (not shown). A voltage (±1000 to 2000V) is supplied to the electrode 40 for charging the image bearing member (photoconductor) 1. As the material for the electrode, a phosphor bronze plate with a thickness of about 0.1 mm, stainless steel, and carbon materials such as graphite can be used. It is necessary that the electrode be made of a springy material. A resistor is connected to the charging member 30.

In the above-mentioned figures, for the viewpoint of power saving, the explanation is made with reference to the drugging system in which the charging roller is rotated as the image bearing member is rotated (which has no problems for use in practice), but the charging roller may be rotated, using an external drive source.

Figure 15:
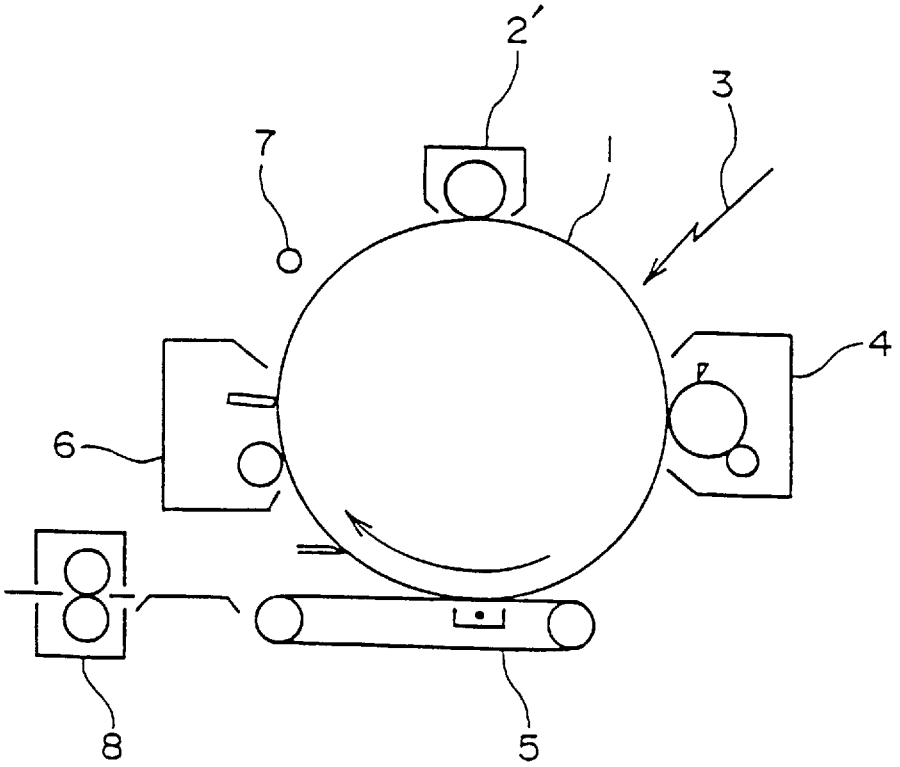
FIG. 15 is a diagram of an image formation apparatus, in which the charging apparatus shown in FIG. 12 is set.

FIG. 15 shows a diagram of an image formation apparatus in which the roller charging apparatus 2' is set.

Figure 16:
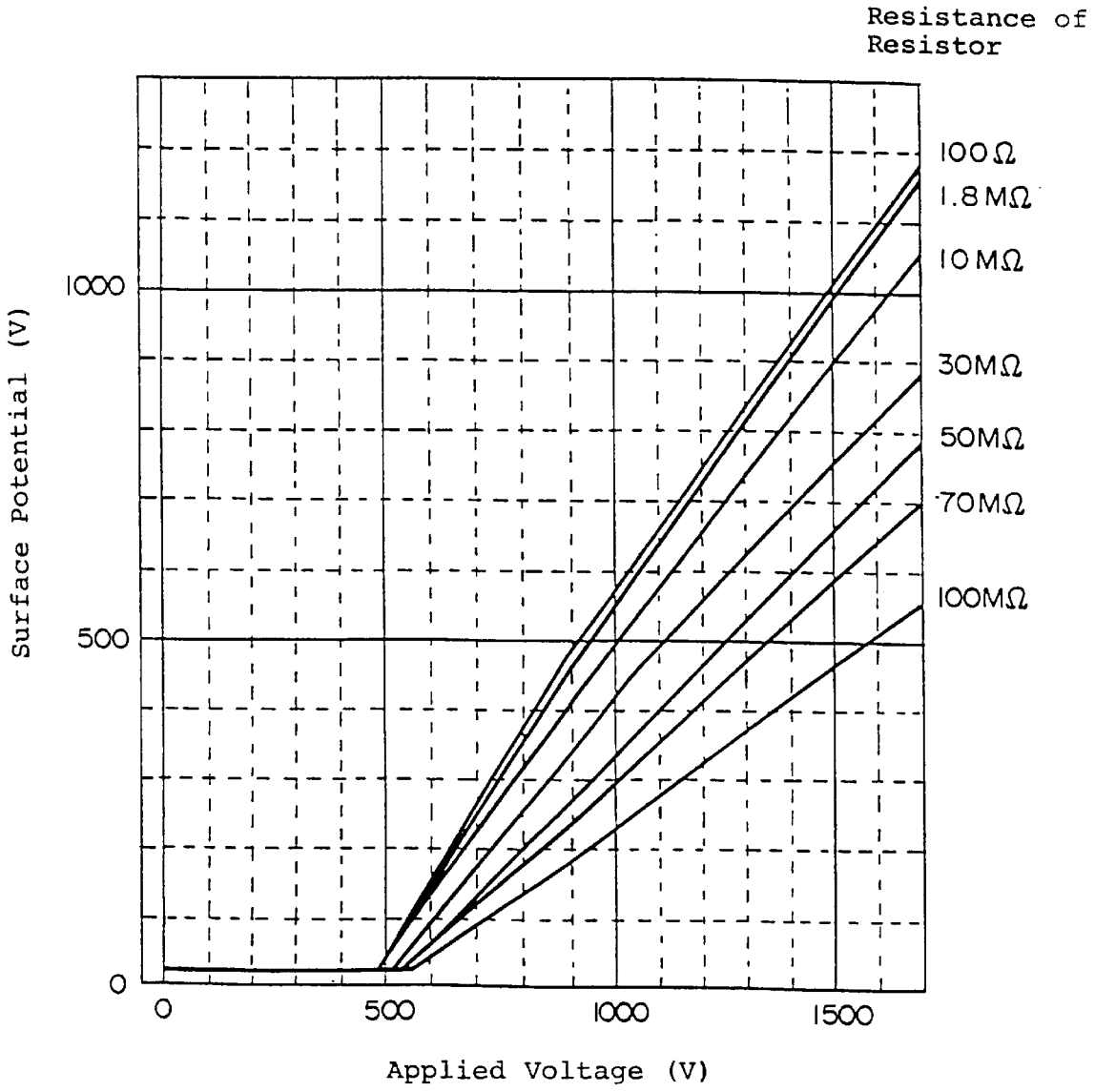
FIG. 16 is a charging characteristics diagram of the charging apparatus shown in FIG. 10.
Figure 17:
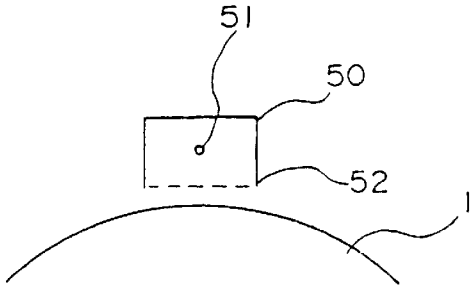
FIG. 17 PRIOR ART
FIG. 17 is a diagram of a conventional corona discharge charging apparatus.
Figure 18:
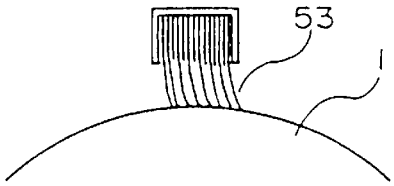
FIG. 18 PRIOR ART
FIG. 18 is a diagram of a brush contact charging apparatus.
Figure 19:
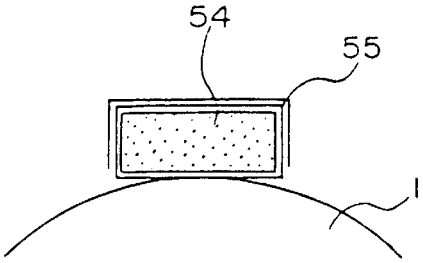
FIG. 19 PRIOR ART
FIG. 19 is a diagram of a stationary contact charging apparatus.

The connected resistance value varies depending upon the value of the surface resistance of the charging member. In the case of a charging member with a specific resistance of about $1.5\times10^4$ Ω·cm, with the dispersion of a resin therein, the resistor's resistance value dependance is exhibited as can be seen in the examples of the charging characteristics shown in FIG. 16, and when the resistance is 100Ω or less, and the image bearing member (photoconductor) has a damaged portion which reaches an electroconductive substrate thereof, the output from the connected power source becomes unstable (which cannot be shown by the graph), provided that when the specific resistance amounts to $10^6$ or $10^7$ (Ω·cm), the connected resistance can be made small, but when there is a portion with an extremely low resistance in the charging member, it is desirable to connect a resistor with a resistance of 100 Ω or more when the safety is taken into consideration. On the other hand, when the resistor with a resistance of 100 Ω or more is connected, it is necessary to apply a voltage of 2000 V or more in order to obtain the target charging potential, and when this is done, the generation of ozone and nitrogen oxides is rapidly increased. This is not preferable. Normally, using the charging member at 1500 V or less is effective in order to maintain the processing performance of the charging member for a long period of time. Normally it is desirable to connect a resistor with a resistance of about 1 MΩ.

When it is tried to carry out uniform charging operation, using a charging member composed of a carbon-fibers-dispersed resin or rubber, the usable scope of such a resistor is necessarily limited to resistors with a resistance up to 100 MΩ. The range of the resistance is set in view of the overall characteristics such as the absorption characteristics of corona products, charging characteristics, mechanical durability and image quality.

The specific resistance of the charging member mentioned here is the value of the resistance of the charging member which is measured by sandwiching the charging member between a pair of copper electrodes with a contact area of 10 mm×10 mm, and applying 5 V thereto. The surface resistance of the charging member is the value measured by setting an electrode of 10×3 mm being away from the charging member and applying 5 V thereto.

The charging apparatus can also be used for image transfer, sheet separation, charge quenching and other objects, as long as the contamination by toner can be avoided, in the same manner as in the case of the blade charging apparatus.

Figure 22:
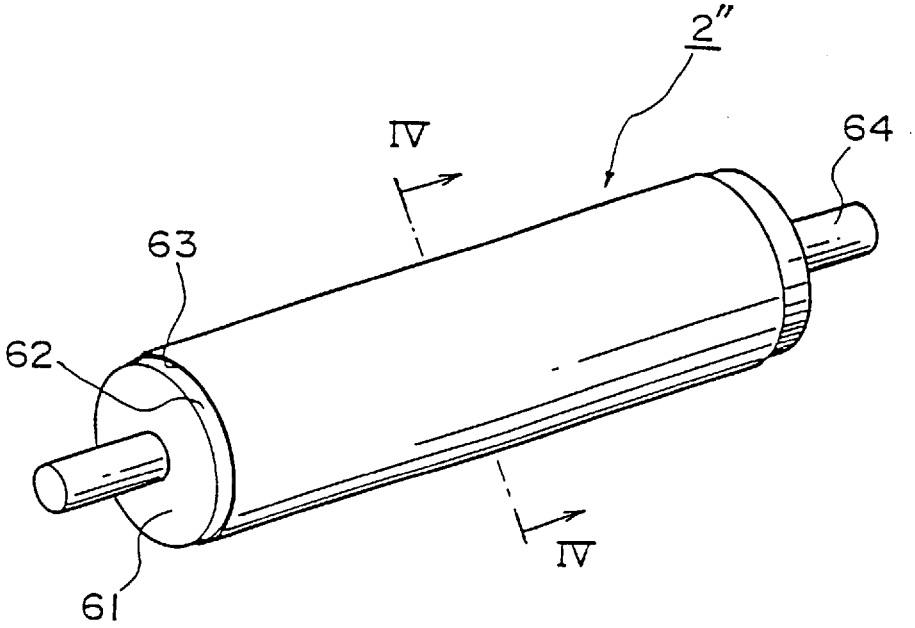
FIG. 22 is a schematic view of an another type blade charging apparatus.
Figure 23:
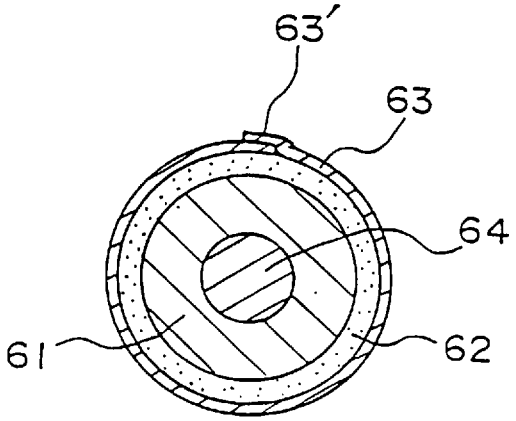
FIG. 23 is a cross-sectional view taken on line IV—IV in FIG. 22.
Figure 24:
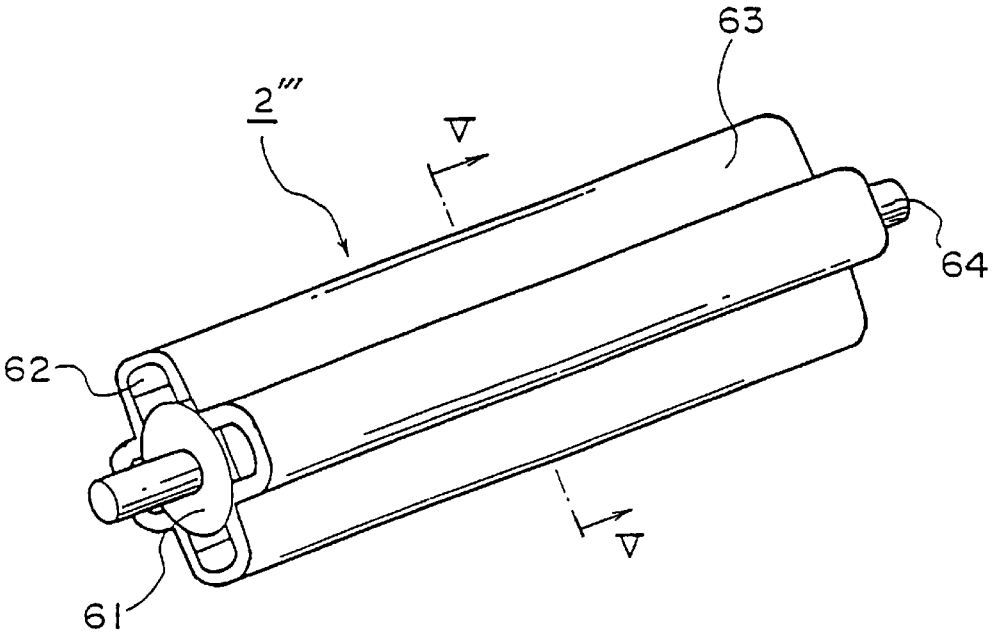
FIG. 24 is a schematic view of a further type blade charging apparatus.
Figure 25:
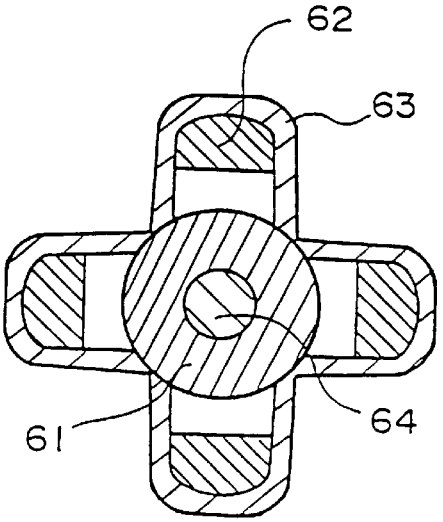
FIG. 25 is a cross-sectional view taken on line V—V in FIG. 24.
Figure 26:
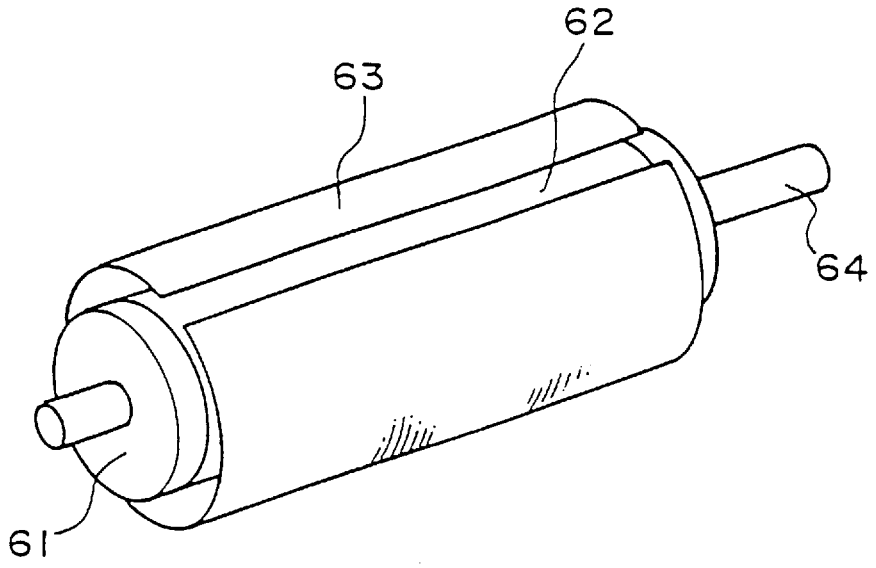
FIG. 26 is a diagram for explaining how to wind a charging member onto the charging apparatus shown in FIG. 22.

FIG. 22 is an outline view (perspective view) of another blade charging apparatus, and FIG. 23 is a cross-sectional view, taken on line IV—IV, in FIG. 22. As the material for a substrate 61, aluminum, brass, iron and varieties of plastics can be used. A charging apparatus (charging roller) 2" can be set up as follows. As a core member 61, a substrate with a fin with a width of about 5 to 10 mm in the longitudinal direction thereof is used. This substrate is coated with an elastic material 62, such as a felt, a polyurethane foam, an unwoven fabric, or a cotton product, and a charging member 63 comprising as the main component active carbon fibers is coated on the outermost surface thereof with which the image bearing member (photoconductor) comes into contact. In FIG. 22 and FIG. 23, 64 indicates a core metal (roller shaft), 63' indicates a connecting portion for the charging member 63. The charging roller 2" is stationarily used for a predetermined period of time (with a predetermined number of copies), so that the charging member is wound around the substrate in such a manner that the substrate is wrapped with the charging member (i.e. the charging member is set in the charging apparatus in such a manner that the end portions of the charging member do not contact). In other words, spiral winding of the charging member is not preferable since the end surfaces of the charging member come into contact with the image bearing member, so that black stripes or white stripes are formed on the images formed. In addition to the substrate as shown in FIG. 22, there can also be employed a substrate provided with a fin in the longitudinal direction of the image bearing member as shown in FIG. 24. FIG. 25 is a section of a charging apparatus 2"" taken on line V—V in FIG. 24.

It is preferable that an elastic member 62 be capable of maintaining close contact with the image bearing member, have good repulsion properties in order to lengthen the life of the image bearing member, and be made of a material with extremely low hardness. As such a material, a polyurethane based foamed material is preferable, but it is unnecessary to limit the material to a particular material as long as it satisfy the above objects. The temperature at which the charging apparatus is used is 50° C. or less even when the temperature of the image bearing member is elevated, so that almost all materials can be employed. It is desirable that the hardness be 20N or less. An elastic material with a hardness of 8 or less is further desirable. This hardness is important since at this hardness, the close contact of the elastic member with the image bearing member is improved and the formation of unnecessary scratches on the image bearing member can be avoided, and the deformation of the charging member can be reduced. The hardness mentioned here is determined by setting an initial film thickness of a sample which is determined by the application of a load of 4.9N thereto, using a hardness tester, performing 75% pre-compression using a disk with a diameter of 200 mm, followed by performing 25% compression for 20 seconds, and then measuring the hardness of the sample (JIS-K-6401). The unit is N (=kgf).

In the case where the substrate of the charging apparatus is in the shape of a rod, a press-cut product is used, while in the case where the substrate is in a fin-having shape as shown in FIG. 24, an elastic material cut into a strip is applied to the substrate, using an adhesive agent, or a sheet of an elastic material is applied to the substrate so as to cover the entire surface of the substrate. It is desirable that the elastic material to be applied have a thickness of about 2 to 10 mm, and that the contact width with the image bearing member be at least 2 mm or more after the charging member is coated with the elastic material. This contact width reduces the ripple potential at the time of charging, and therefore is important to obtain uniform images. Even if the charging member is deformed due to the use thereof for an extended period of time, the above contact width serves to maintain the charging characteristics and the image characteristics.

In order to charge the image bearing member, the charging member is coated from above the elastic member. This charging member uses a material for absorbing ozone and nitrogen oxides which are generated at the time of charging of the image bearing member, at the same time as the discharging. The material is the active carbon fiber. Final shapes of commercially available active carbon fibers are in such shapes as described above. When the image bearing member is merely charged, any type of active carbon fibers can be employed. However, when the active carbon fibers are in contact with the image bearing member for a long period of time as in electrophotographic photoconductors or laser beam printers, the durability of the active carbon fibers is particularly important. The active carbon fibers in the shape of a fabric can achieve the above object, and a fabric with possibly finest interstices, having large tensile strength is preferable.

For example, in the case of polyacrylnitrile active carbon fibers with a specific surface area of 700 to 900 $m^2/g$ and a fiber diameter of 10 to 12 $\mu$m, the single fiber strength thereof is as small as about 2 to 1.5 g/d, but the strength of a span yarn of 20 to 30 fibers is much higher than that of a felt or an unwoven fabric which is a mere composite of single fibers (that is, about 15 to 25 kg/cm). Of various types of the active carbon fibers, the fabric type has the greatest durability unless there is applied thereto such a load that easily makes scratches on the image bearing member. Examples of fabrics (charging members) that can be used are FW210 and 310 made by Toho Rayon Co., Ltd., and ACC507 made by Nippon Kynol Inc. In accordance with the objects, a suitable type is selectively used.

The charging member for use in the present invention has an extremely small specific volume resistivity of 100 Ω·cm or less and therefore is excellent in the stability of the charging potential with respect to changes in the environmental conditions. With respect to the resistance to discharge breaking of the image bearing member, there is a tendency that the discharge breaking is more difficult to occur in comparison with the method using a charging roll in which a resistance controlling agent is dispersed. However, when there are pinholes or a peeled-off portion in a photosensitive layer, there is the risk that the charging member may be broken when connected to a high voltage power source as it is, due to the low specific volume resistance thereof. In order to prevent this problem, the charging member is used, with a protective resistor with a resistance of about 1 MΩ being connected between the power source and the charging apparatus, and the electric field applied to the image bearing member being set at $3.5\times10^5$ V/cm or less.

With reference to the following examples, the present will now be explained in further detail:

EXAMPLE 1

An aluminum drum with a diameter of 80 mm and a length of 340 mm, including a support member with a thickness of 1.2 mm, was coated with a coating liquid by a dipping method, the coating liquid comprising a polyamide resin and ultra fine particles of $TiO_2$ (made by Ishihara Sangyo Kaisha, Ltd.) dispersed in the polyamide resin, and the coated liquid was dried with the application of heat thereto, whereby an undercoat layer with a film thickness of about 4 $\mu$m was formed. A coating liquid composed of a trisazo pigment and a polyester resin in which the trisazo pigment was dispersed was coated on the undercoat layer, and dried, whereby a charge generation layer with a film thickness of about 0.15 $\mu$m was formed. Furthermore, a coating liquid composed of a stilbene compound dispersed in a poly-carbonate resin (C-1400, made by Teijin Chemicals, Ltd.) was then coated and dried, whereby a charge transport layer with a film thickness of 28 $\mu$m was formed. Thus, an organic photoconductor 1 was fabricated. This was used as an experimental sample.

As an apparatus for confirming the characteristics of the above sample, a digital copying machine (Imagio 420, made by Ricoh Co., Ltd.) was used, with the contact charging apparatus 2 shown in FIG. 1 being used as the charging apparatus.

As the core member 21 for the charging apparatus 2, an urethane foam with a hardness of 8 degree, cut with a width of 8 mm, was used. In a central portion on the bent side, the electrode 23 made of a 3 mm wide copper foil tape was attached along photoconductor 1. The core member 21 was then covered with the charging member 20 made of two fabrics one over the other (FW-310 or FW410, made by Toho Rayon Co., Ltd.), which was cut with a length of 250 mm, and whose cut edges were subjected to fray-prevention treatment with a width of 2 to 3 mm, using a quick-drying epoxy resin, and fixed to the holder 22 made of an acrylic resin by screws, and then incorporated into the shield case 24, whereby the charging apparatus 2 was constructed. The surface resistance of the charging member 20 was 1 to $2\times10^2$ Ω/cm. The charging apparatus 2 was connected to a DC power source (-output) via a resistor with a resistance of 1.8 MΩ. The contact width of the charging member 20 with the image bearing member (photoconductor) was set at about 5 mm.

The characteristics confirmation was carried out with respect to the amount of ozone generated, ripples at the time of charging, image quality, damaged state of the charging member, and others.

Figure 9:
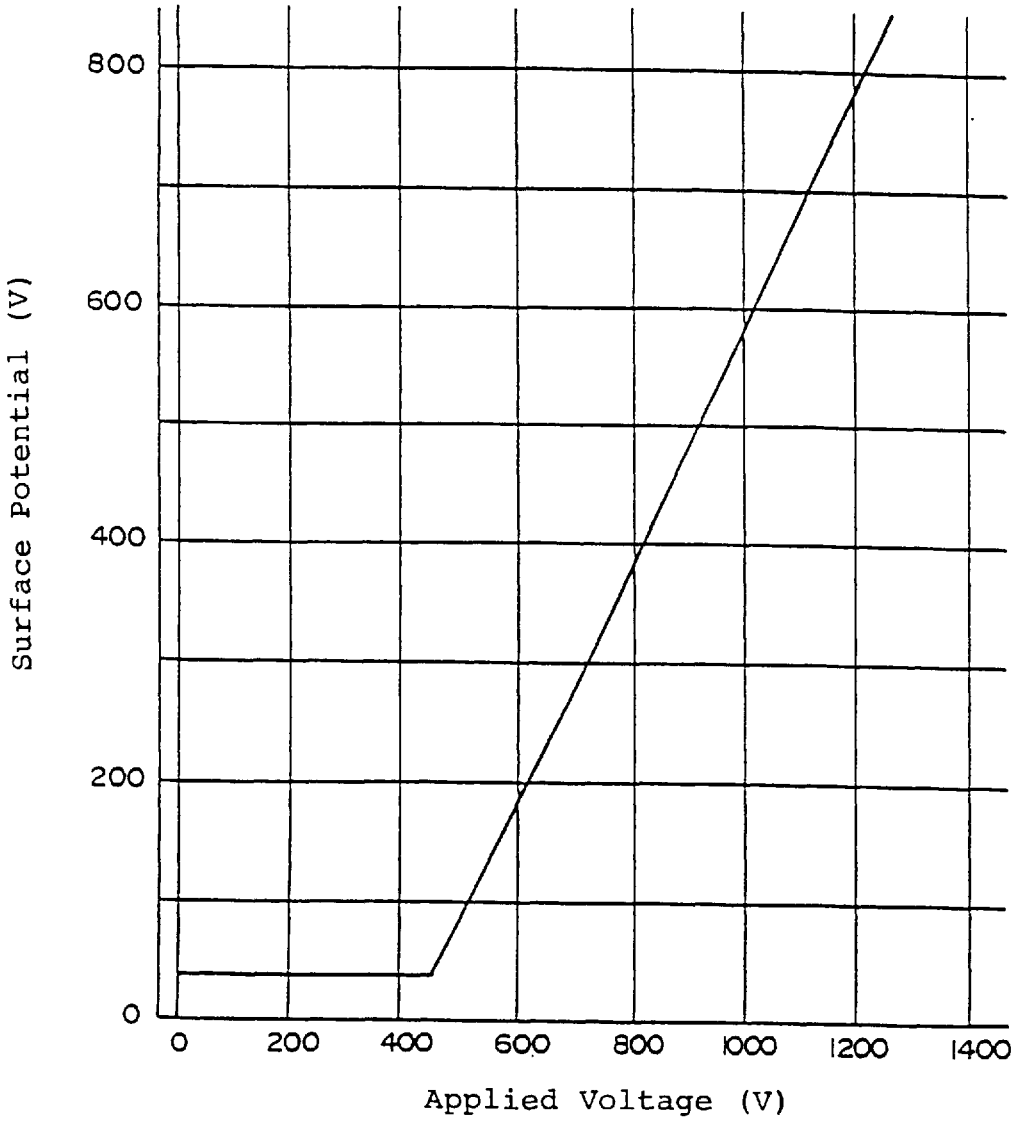
FIG. 9 is a charging characteristics diagram of the charging apparatus of Example 1 after about 100 copies were passed therethrough.

FIG. 9 shows the charging characteristics (application of -voltage) after about 100 sheets. As can be seen from this figure, the charging characteristics were excellent. With the copying machine being set in a free-run state, only a charging apparatus was operated to perform a charging operation for 18 hours, corresponding to the making of 12,000 copies, with the charging potential set at −900 V, and the amount of ozone generated in an adjacent area extremely close to the charging apparatus 2. The result was that the detected amount thereof was below the limit of detection thereof (0.01 ppm), and there was no odor of ozone. As to the nitrogen oxides (NOx), the detected amount was also below the limit of detection thereof (0.001 ppm).

Furthermore, with the charging potential being set at −850 V, image evaluation was performed with respect to 1500 copies. The resolution was in the range of 4.5 to 6.3 (lines/mm) and the sharpness was good. The ripple of the potential in the peripheral direction after the image formation was initially about 5 V, and increased to about 15 V after making 1500 copies. The ripple potential was almost stable. There was slight deposition of toner and paper dust on the charging member 20, but such deposition had almost no adverse effects on the charging portion. Furthermore, there was almost no abrasion and frays in the charging member 20, and neither white strips nor black strips, which constitute a problem to images, were formed. Stripes caused by abrasion were visually observed in the circumferential direction of the photoconductor 1, but such stripes did not appear on the images. No quality deterioration such as image flow was confirmed even when the photoconductor was allowed to stand in such a state that the charging apparatus 2 was in contact with the photoconductor, for 2 to 3 days, and after repeating the charging operation only for the charging apparatus 2 corresponding to the making of 30,000 copies.

Thus, it was confirmed that the carbon fibers in the form of a fabric, having the adsorption function, have a sufficient charging function for the image bearing member (photoconductor) and constitute a charging member free from the generation of ozone.

EXAMPLE 2

Roller Charging Apparatus

An aluminum drum with a diameter of 80 mm and a length of 340 mm, including a support member with a thickness of 1.2 mm, was coated with a coating liquid by a dipping method, the coating liquid comprising a polyamide resin and ultra fine particles of $TiO_2$ (made by Ishihara Sangyo Kaisha, Ltd.) dispersed in the polyamide resin, and the coated liquid was dried with the application of heat thereto, whereby an undercoat layer with a film thickness of about 2 μm was formed. A coating liquid composed of a trisazo pigment and a polyester resin in which the trisazo pigment was dispersed was coated on the undercoat layer, and dried, whereby a charge generation layer with a film thickness of about 0.15 μm was formed. Furthermore, a coating liquid composed of a stilbene compound dispersed in a poly-carbonate resin (C-1400, made by Teijin Chemicals, Ltd.) was then coated and dried, whereby a charge transport layer with a film thickness of 28 μm was formed. Thus, an organic photoconductor 1 was fabricated.

As an apparatus for confirming the characteristics of the organic photoconductor, a digital copying machine (Imagio 420, made by Ricoh Co., Ltd.) was used, with the roller charging apparatus 2' shown in FIG. 12 being used as the charging apparatus.

As the roller main body 32 for the charging apparatus 2', a brass roll with a diameter of 15 mm was made by grinding brass. As the elastic member 33, an urethane foam with a hardness of 5 degree and a thickness of 5 mm, with one side surface thereof being coated with an adhesive agent liquid, was prepared. As the charging member 30, an acrylic resin sheet (hardness 76 degree, volume resistance $6.6\times10^3$ Ω·cm, surface roughness 1 to 15 μm) was applied to the urethane foam from the above thereof. The charging member 30 was cut so as to have a width of 30 mm and spirally wound around the brass roll, and a copper foil sheet with a width of 2 mm was applied to the opposite ends of the brass roll, in such a length that make possible the electric conduction between the charging member 30 and the roll main body.

The thus constructed charging roller was attached to a main charging apparatus. The attachment was performed in accordance with FIG. 13 and FIG. 14, by inserting a 0.0 mm thick phosphor bronze plate serving as the electrode 40 between the spring and the supporting block 39 for contacting with the electrode 40. A 1.8 MΩ resistor was connected to the electrode 40 via a lead wire, and a DC power source (−output) was further connected thereto.

Effects were confirmed by adjusting the applied voltage in such a manner that the charging potential was in the range of −850 to 900 V, and continuously performing the charging operation for 8 hours per day, for 10 days (corresponding to the making of about 53000 A-3 size copies), without using copy paper and without a development unit. The charging characteristics, the amounts of ozone and nitrogen oxides generated, the ripples at the time of charging, image quality, and the state of damage to the charging member were inspected before and after the above-mentioned continuous operation. The amounts of the generated ozone and nitrogen oxides were measured with the applied voltage being increased to −1500 V, and the charging potential being increased to −1000 V, to perform the confirmation of the effects.

For the detection of ozone, an ozone inspection tube (made by GASTEC corp.) was employed, and for the detection of nitrogen oxides, a chemiluminescence system NOx analyzer (DY-8400 made by Dylec corp.) was employed.

In the course of a two-week operation, the amount of ozone detected was below the limit of detection thereof (0.01 ppm) and no odor of ozone was felt. With respect to nitrogen oxides (NOx), the amount thereof was also below the limit of detection thereof (0.001 ppm).

The charging characteristics were initially lowered by 50 to 60 V, but thereafter there was no particular problem, although the charging potential was lowered by about 30 V due to the scraping of the photoconductor.

The charging member was slightly worn, but with respect to the image quality, the resolution was 4.5 lines/mm or more, and the sharpness was excellent. The potential ripple in the circumferential direction after image formation was increased only by about 15 to 20 V in 10 days.

10 days after a non-paper passing operation, even when the photoconductor was allowed to stand in such a state that the charging apparatus was remained in contact with the photoconductor for 2 to 3 days, no quality deterioration such as image flow occurred.

Thus, it was confirmed that even when carbon fibers having the adsorption function are pulverized and dispersed in the resin, and worked into a sheet, the sheet maintains the adsorption and catalytic actions for ozone and nitrogen oxides, and corona products can be effectively removed by the sheet, and constitutes excellent charging member, since the deterioration of electrophotographic characteristics caused by the sheet as a charging member is small.

EXAMPLES 3 TO 6, COMPARATIVE EXAMPLES 1 AND 2

5 samples with fiber lengths of 150 to 200 μm, 70 to 80 μm, 30 to 50 μm, 10 to 20 μm, 5 to 10 μm, and 5 μm or less were prepared by pulverizing active carbon fibers (corresponding to the product under the trademark "FW210", made by Toho Rayon Co., Ltd.) produced by pulverizing polyacrylonitrile fibers (with a fiber diameter of about 10 μm), which are respectively referred to Comparative Example 1, Example 3, Example 4, Example 5, Example 6, and Comparative Example 2. Each of these samples was separately dispersed in an amount of 70% in an acrylic resin. Each dispersion was then subjected to milling to form a sheet with a thickness of 0.25 mm, which was used as a charging member.

Each of these sheets was cut with a width of 35 mm. A rod made of brass with a diameter of 15 mm was used as a core metal therefor. An elastic member sheet (LE-20, made by Roger Inoac Corp.) with a thickness of 2 mm, with a spray adhesive being applied to one side thereof was spirally wound around the core metal without forming any gap therebetween, whereby a substrate body was prepared. An adhesive-applied film (with a thickness of 100 μm was applied to the above-mentioned charging member, and was then cut with a width of 35 mm. A spray adhesive was sprayed on the film surface. The charging member was then spirally applied in such a manner that the flash line thereof did not fall on valley portions of the elastic member of the above-fabricated substrate main body, with the flash line being shifted by 1 mm therefrom, and the opposite end portions were treated, whereby each charging roller was fabricated.

Each of the above charging roller was incorporated into a main charging apparatus modified for the charging roller of an experimental machine (Imagio 420, made by Ricoh Company, Ltd.) for confirming the effects of the charging roller, whereby each charging apparatus was made.

The experimental method was as follows: In the above-mentioned experimental machine, there was incorporated a 28 μm thick three-layered organic photoconductor composed of an aluminum support, and an undercoat layer (UL), a charge generation layer (CGL) and a charge transport layer (CGL) which were successively formed on the aluminum support. The above fabricated charging roller was attached to the main charging apparatus so as to form a drugging system of the charging roller being rotated in accordance with the rotation of the photoconductor. The image characteristics were investigated with the applied voltage set in such a manner that the initial charging potential was about −730 V, and a development bias potential was set at −550 V. The characteristics were investigated with respect to the charging characteristics, the image characteristics and ozone concentration for 100 hours at the maximum, corresponding to A-3 size copies. The results are shown in TABLE 2.

TABLE 2

| Examples/ Comparative Examples | Length of Fiber (μm) | Charging Characteristics Vs (V) | Charging Characteristics Ripple Potential (V) | Image Characteristics Resolution (lines/mm) | Image Characteristics Half-tone Uniformity | Ozone Degree |
|---|---|---|---|---|---|---|
| Ex. 3 | 70–80 | 735 | 30–45 | 4.5–5.6 | 0.31–0.34 | No generation in 100 hrs. |
| Ex. 4 | 30–50 | 720 | 20–30 | 5.0–6.3 | 0.32–0.36 | No generation in 100 hrs. |
| Ex. 5 | 10–20 | 730 | 15–25 | 4.5–5.6 | 0.35–0.37 | No generation in 100 hrs. |
| Ex. 6 | 5–10 | 735 | 20–25 | 5.0–5.6 | 0.33–0.38 | No generation in 100 hrs. |
| Comp. Ex. 1 | 150–200 | 750 | 60–100 | 3.6–4.5 | 0.29–0.45 | No generation in 100 hrs. |
| Comp. Ex. 2 | 5 or less | 720 | 30–40 | 4.5–5.0 | 0.36–0.40 | 0.025 ppm in 64 hrs. |
| Note | | At the application of −1400 V | Ripples in Potential | | Image Density min/max | |

Note: A 1.8 MΩ resistor was used as a protective resistor for DC power source.

When the fiber length was as long as 70 μm, there was a tendency that ripples were increased at the time of the charging, so that the roughness of the half-tone images became gradually conspicuous. When the fiber length was further increased to 150 μm, the roughness further increased with respect to the resolution and the half-tone uniformity and such fibers could not be used in practice. When the fibers were finely pulverized to less than 5 μm, no substantial defects were formed with the image quality, but some depression was observed in a dot pattern, and the deterioration of the ozone adsorbing characteristics became conspicuous, and there was a problem with respect to the durability thereof. Within the scope of the above-mentioned examples, the range of 50 to 5 μm is an appropriate range. In the above, 100 hours corresponds to the making of 125,000 copies in terms of A-3 size copy paper.

EXAMPLES 7 TO 10, COMPARATIVE EXAMPLES 3 TO 4

Active carbon fibers of the same type as employed in Example 6 were pulverized so as to have a fiber length of 5 to 10 μm and dispersed in an acrylic resin, in an amount of 40, 50, 60, 70, 80, 90 and 94%. Each dispersion was then subjected to milling to form a sheet with a thickness of 0.2 to 0.30, which was used as a charging member. These sheets are respectively referred to as Comparative Examples 3, 4, Examples 7, 8, 9, 10 and Comparative Example 5. By use of each of these sheets, and rods made of brass with a diameter of 15 mm, charging rollers were fabricated and charging apparatus were assembled in the same manner as in Example 6. The image characteristics were investigated with the applied voltage set in such a manner that the initial charging potential was about −730 V, and a development bias potential was set at −550 V. The confirmation time period was 100 hours at the maximum (125,000 copies, using A4 size copy paper). The results are shown in TABLE 3.

TABLE 3

| Examples/ Comparative Examples | Dispersed Amount (%) | Charging Characteristics Vs (V) | Charging Characteristics Ripple Potential (V) | Image Characteristics Resolution (lines/mm) | Image Characteristics Half-tone Uniformity | Ozone Degree (Detected Amount ppm) |
|---|---|---|---|---|---|---|
| Ex. 7 | 60 | 730 | 20–25 | 4.5–5.6 | 0.31–0.35 | 0.02 ppm in 70 hrs. |
| Ex. 8 | 70 | 745 | 20–25 | 4.5–5.6 | 0.33–0.36 | No generation in 100 hrs. |
| Ex. 9 | 80 | 730 | 25–30 | 4.5–5.6 | 0.29–0.35 | No generation in 100 hrs. |
| Ex. 10 | 90 | 760 | 35–40 | 4.5–5.0 | 0.29–0.31 | No generation in 100 hrs. |
| Comp. Ex. 3 | 40 | 670 | 60–80 | 5.0–6.3 | 0.21–0.32 | 0.01 ppm in 4 hrs. |

TABLE 3-continued

| Examples/ Comparative Examples | Dispersed Amount (%) | Charging Characteristics Vs (V) | Charging Characteristics Ripple Potential (V) | Image Characteristics Resolution (lines/mm) | Image Characteristics Half-tone Uniformity | Ozone Degree (Detected Amount ppm) |
|---|---|---|---|---|---|---|
| Comp. Ex. 4 | 50 | 720 | 25–35 | 4.5–6.3 | 0.29–0.35 | 0.02 ppm in 40 hrs. |
| Comp. Ex. 5 | 94 | 840 | 80–110 | 4.0–5.0 | 0.41–0.48 | No generation in 100 hrs. |
| Note | | At the application of −1400 V | Ripples in Potential | | Image Density min/max | |

Each of the characteristics greatly varies depending upon the amount of the dispersed active carbon fibers. The ripple potential in the charging potential was relatively stable when the dispersed amount was in the range of 50 to 90%, but outside the range, there was a tendency that the ripple potential increased, and the image S/N was affected. When the added amount was small, the sharpness was increased, and the resolution was apparently increased, but the uniformity tended to decrease. When the added amount exceeded 90%, dot patters were difficult to be reproduced. With respect to the ozone adsorption characteristics, the smaller the added amount, the desirable. Practically, it is preferable that the added mount be 60% or more. Overall, it is preferable that the added amount be in the range of 60 to 90%.

Figure 21:
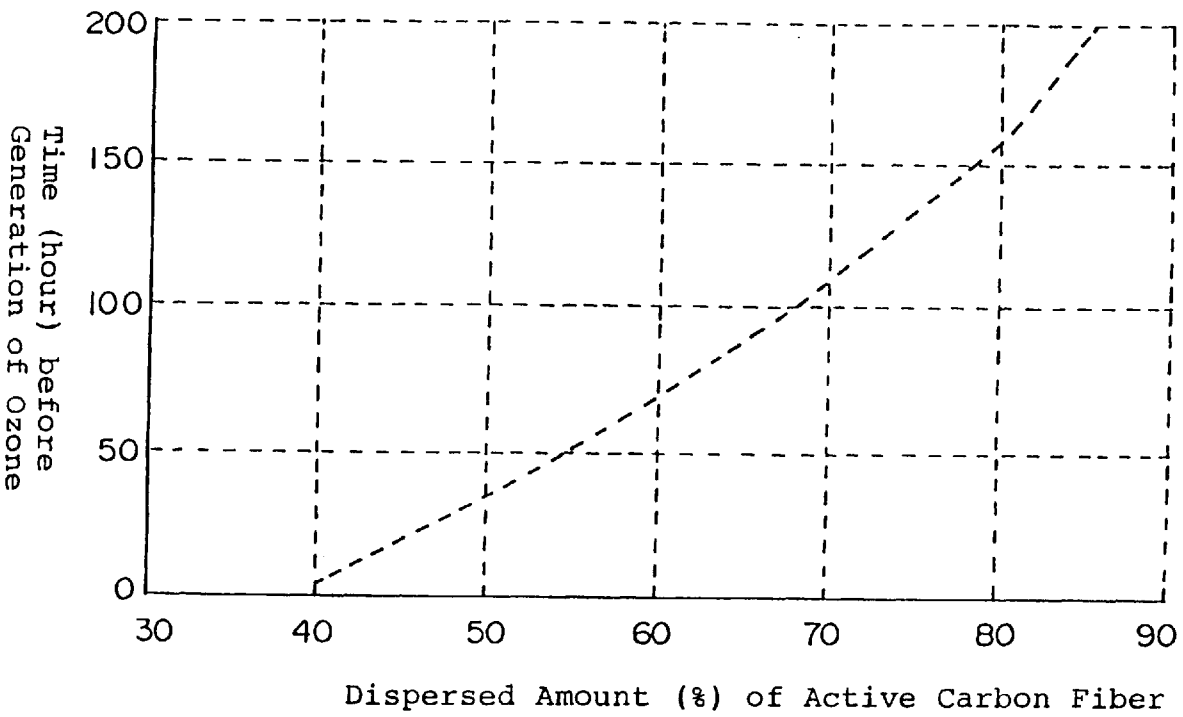
FIG. 21 is an ozone adsorption characteristics diagram in Examples 3 to 10.

FIG. 21 shows approximately the ozone adsorption characteristics, in particular, the amount of the active carbon fibers and the ozone generation time, provided that there is an error of 4 to 8 hours therein.

EXAMPLE 11

A surface-washed aluminum cylinder with a diameter of 80 mm and a length of 340 mm was coated with a coating liquid by a dipping method, the coating liquid comprising a polyamide resin and ultra fine particles of $TiO_2$ (made by Ishihara Sangyo Kaisha, Ltd.) dispersed in the polyamide resin, and the coated liquid was dried with the application of heat thereto, whereby an undercoat layer with a film thickness of about 2 $\mu$m was formed. A coating liquid composed of a trisazo pigment and a polyester resin in which the trisazo pigment was dispersed was coated on the undercoat layer, and dried at 120° C., whereby a charge generation layer with a film thickness of about 0.15 $\mu$m was formed. Furthermore, a coating liquid composed of a stilbene compound dispersed in a polycarbonate resin (PCX-5, made by Teijin Chemicals, Ltd.) was then coated and dried, whereby a charge transport layer with a film thickness of 28 $\mu$m was formed. Thus, an organic photoconductor was fabricated.

As an apparatus for confirming the characteristics of the above photoconductor, an electrophotographic copying machine (Imagio 420, made by Ricoh Co., Ltd.) was used. A charging apparatus was fabricated with such structure that the charging apparatus can be inserted into the main charger of Imagio 420 and can be taken out therefrom, and the angle thereof can be changed with a degree of 30 per 25,000 copies, and is vertically movable by about ±2 mm.

The charging apparatus was fabricated as follows: An aluminum rod was worked into a roll with a diameter of 13 mm. The roll was the coated with an elastic member (made by Inoac Corp.) in a cylindrical shape, having a thickness of 6 mm, a hardness of 10N and a density of 18 kg/cm$^2$, which was made from an urethane foam by dieing out press. A charging member composed of a double-layered fabric made of the active carbon fibers (FW210, Toho Rayon Co., Ltd.) was then wound around the above elastic member, and the opposite end portions were treated, whereby a roll charging member as shown in FIG. 22 was fabricated. The thus fabricated roll charging member was attached to a modified main charger. The contact width of the charging member with the image bearing member was about 4.5 mm. This charging apparatus was set in the electrophotographic copying machine, and was connected to a 2.3 MΩ resistor and a 3 kV output D. C. power source.

Figure 27:
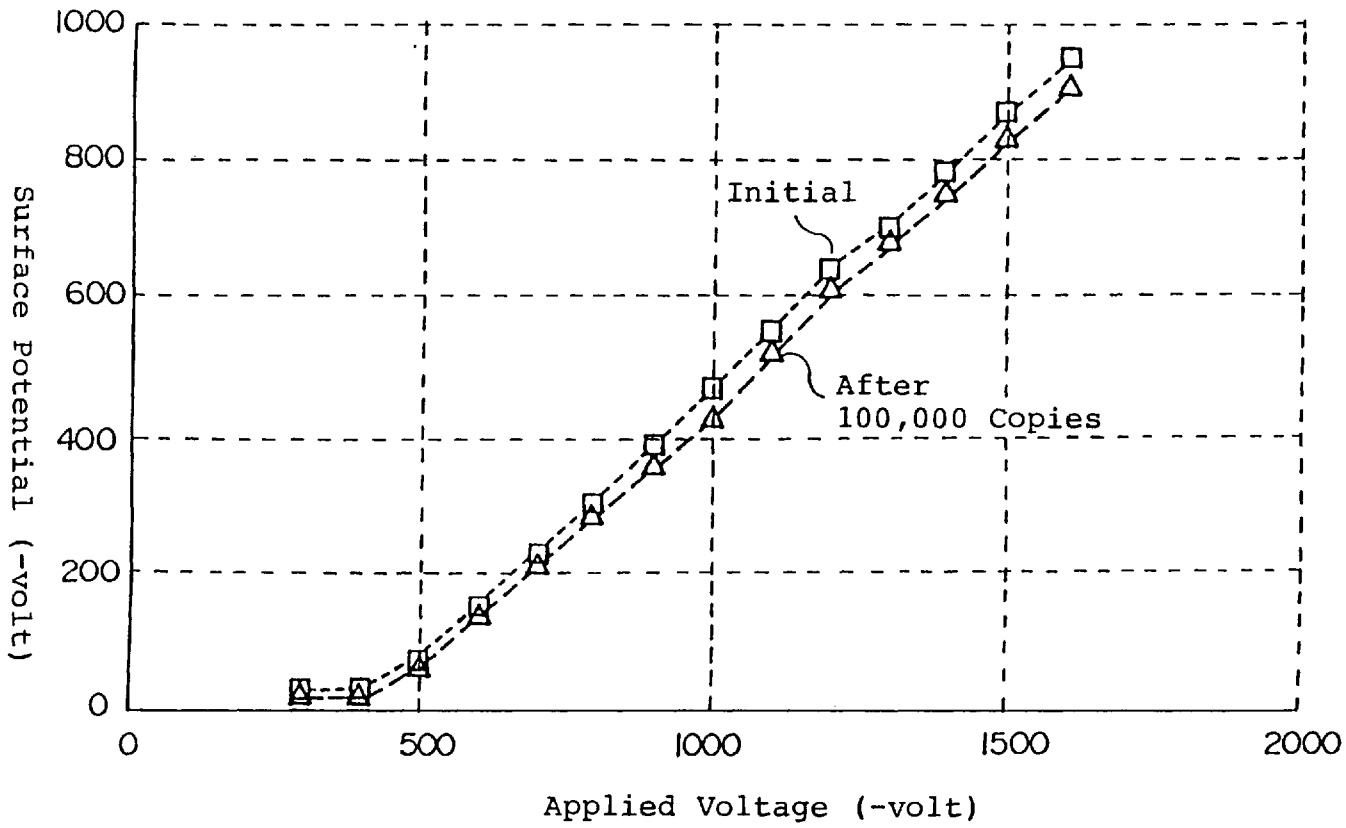
FIG. 27 is a charging characteristics diagram in Example 11 at the initial paper passing and after the passing of 100,000 sheets of paper in Example 11.

The effects were confirmed as follows: The output of the power source was adjusted in such a manner that the charging potential was set at −800 V. When the characteristics were evaluated, all the units necessary for the copying operation were incorporated, and except when such evaluation was made, only the charging apparatus and a charge quenching lamp were ON for operation. For the evaluation, 5,000 copies were made per day, with the contact position of the charging apparatus with the image bearing member being changed per 25,000 copies, and the evaluation was made when 100,000 copies were made. The development bias potential was set at −600 V. FIG. 27 shows the changes in the charging potential.

The ripple of the charging potential was initially 10 V or less, and was increased to only 15 to 20 V even after the making of 25,000 copies for the confirmation of the effects. On the other hand, with respect to image quality items, the resolution was initially 6.5 lines/mm, and 5.0 lines/mm after the making of 25,000 copies and 100,000 copies, and the half-tone uniformity was such that slight stripe-shaped patterns were observed from the initial stage in the circumferential direction due to the sliding contact with the charging member, and such patterns were increased at the completion of the making of 25,000 copies for the confirmation of the effects, provided that the appearance of the patterns was below such a level that becomes a problem in view of the practical use thereof, and the S/N was good. Frays of the charging member were not confirmed. The generation of ozone was not confirmed even after the making of 100,000 copies.

Thus, it was confirmed that the charging apparatus of the present invention was good for use in practice.

A 100,000-copies characteristics evaluation was carried out with the charging member being stationarily set, without rotating the same.

The resultant charging characteristics were almost the same as shown in FIG. 27. However, the ripple of the charging potential was increased to 25 to 40 V when 100,000 copies were made. With respect to the image quality items, the resolution and the sharpness were almost the same as those in Example 11 at the completion of making 100,000 copies for the confirmation of the effects, but the undulations at the edges of characters were increased and the deterioration was confirmed. In the half-tone images, stripes were formed in the entirety thereof, in which 5 or more intense black points and stripes were observed, which will become a problem for use in practice. It was impossible to stop the appearance of such stripes even when the charging potential was increased by 100 V, and even when the development bias voltage was reduced to −550 V. It was confirmed that this was caused by slight frays in the charging member and scratches formed in the photoconductor. The generation of ozone was not confirmed even after the making of 100,000 copies.

EXAMPLE 12

A charging apparatus was set up in the same manner as in Example 11 except that each of elastic members with a hardness of 4, 8 or 15N (density of 20 to 45 kg/m$^2$) was used, and the characteristics evaluation was performed under the same conditions as in Example 11.

With respect to the charging apparatus using the elastic member with a hardness of 4N and the charging apparatus using the elastic member with a hardness 8N, the ripple of the charging potential in the circumferential direction was 10 V or less, which was excellent, and images as good as those in Example 11 were obtained. On the other hand, with respect to the charging apparatus using the elastic member with a hardness of 15N, the contact area with the image bearing member was narrowed to about 2 mm, so that there was observed a tendency that the ripple of the charging potential increased to 20 to 25 V. However, by increasing the applied voltage by 30 to 50 V, the S/N was increased, and there was obtained such good image quality that was at the same level as that for the images obtained by the charging apparatus using the elastic member with the lower hardness of 4 or 8N.

The generation of ozone was not confirmed in any charging apparatus.

EXAMPLE 13

An aluminum drum with a diameter of 80 mm and a length of 340 mm was coated with a coating liquid by a dipping method, the coating liquid comprising a polyamide resin and ultra fine particles of $TiO_2$ (made by Ishihara Sangyo Kaisha, Ltd.) dispersed in the polyamide resin, and the coated liquid was dried with the application of heat thereto, whereby an undercoat layer with a film thickness of about 2 μm was formed. A coating liquid composed of a trisazo pigment and a polyester resin in which the trisazo pigment was dispersed was coated on the undercoat layer, and dried, whereby a charge generation layer with a film thickness of about 0.15 μm was formed. Furthermore, a coating liquid composed of a stilbene compound dispersed in a poly-carbonate resin (C-1400, made by Teijin Chemicals, Ltd.) was then coated and dried, whereby a charge transport layer with a film thickness of 28 μm was formed. Thus, an organic photoconductor was fabricated.

As an apparatus for confirming the characteristics of the above photoconductor, an electrophotographic copying machine (Imagio 420, made by Ricoh Co., Ltd.) was used. As a charging apparatus, a roller contact charger was made by modifying the main charger of the copying machine.

For the construction of the charging apparatus, a brass rod was worked into a support roll with a diameter of 15 mm and a length of 270 mm. A spray adhesive (made by 3M) serving as an adhesive was lightly sprayed thereon. The above-mentioned adhesive agent was coated on a polymeric foam (Trademark "Poron LE-20", made by RIC, Rogers Inoac Corp.) with a hardness of 11 to 12 degree and a thickness of 2.0 mm, serving as an elastic member, and the polymeric foam was then applied to a sheet composed of an adhesive-agent-applied polyester film and a charging member so as to be integrated therewith, and cut with a width of 30 mm. The charging member was a 0.03 mm thick sheet composed of an acrylic resin and finely-pulverized active carbon fiber particles dispersed therein in an amount of 88%, which finely-pulverized active carbon fiber particles were prepared by pulverizing active carbon fibers with a fiber diameter of 5 to 15 μm (corresponding to FW410 made by Toho Rayon Co., Ltd.) to active carbon fibers with a fiber length of 20 to 40 μm. The contact width of the sheet with the photoconductor was about 3.3 mm.

The thus prepared charging member sheet was spirally wound around the above-mentioned support roller without forming any gap and the electric conduction between the support roller and the charging member was made, using a copper foil tape.

The resistance value of a resistor to be connected to the charging apparatus was set at 1.8 MΩ, and the output voltage of the voltage feed source was set in such a manner that the charging potential for the photoconductor was −800 V. Thus, 80,000 copies were made for 8 hours per day, so that changes in the charging characteristics, image quality, ozone, nitrogen oxides (Nox), and damage to the charging apparatus were inspected.

For the detection of ozone, an ozone inspection tube (made by GASTEC Corp.) was employed, and for the detection of nitrogen oxides, a chemiluminescent system nitrogen analyzer (DY-8400, made by Dylec Corp.) was employed.

The concentrations of ozone and nitrogen oxides were below the respective limits of detection both initially and after the making of 80,000 copies, and no odor of zone was emitted from the charging apparatus.

There was a tendency that the charging characteristics were gradually lowered. This was caused by the natural lowering of the potential of the photoconductor due the fatigue thereof and also caused by the scraping of the photoconductor, and scarcely caused by the charging apparatus itself. No toner deposition on the background was caused by the lowering of the potential. The initial rank of the sharpness (maximum 5.0) was 4.5 and was reduced to 4.0, and the resolution was reduced from 6.3 to 5.0. There were no problems such as image flow and the characteristics were in a range free from problems for use in practice.

With respect to the degree of the damage to the charging member, some wearing was obviously observed in comparison with the initial stage, but its degree was so small that there was no problem as in the case of the above-mentioned image quality and charging characteristics. Furthermore, it was confirmed that the durability was at least 80,000 copies in terms of the number of copies that can be made.

EXAMPLES 14 TO 16, COMPARATIVE EXAMPLES 6, 7

Elastic members with different hardnesses were prepared for use in the charging apparatus, so that the effects of the hardness on the charging characteristics and image quality were investigated. The surface potential of the photoconductor was set in the range of 780 to −820 V, and the other conditions were the same as in Example 13, provided that the number of copies used for the confirmation of the effects was 10,000 copies. TABLE 4 shows the conditions for the charging member and the results of the inspection. In TABLE 4, the ripple potential indicates the ripple value of the surface potential. The ranking range is from 5.0 to 1.0, and 5.0 is excellent value, and 3.0 or more indicates a practically usable range.

TABLE 4

| | Sample | | | Charging Characteristics | Image Quality | | | |
|---|---|---|---|---|---|---|---|---|
| | No. | Hardness | Film Thickness | Ripple Potential | Resolution | Sharpness | Half-tone Image | Judgment |
| Ex. 14 | 1 | 26 | 1.5 | 10 V | 5.6 | 5.0 | 4.0 | ○ |
| Ex. 15 | 2 | 26 | 3.0 | same as above | 5.0 | 4.5 | 4.5 | ○ |
| Ex. 16 | 3 | 29 | 3.0 | 10–25 | 5.0 | 4.5 | 4.0 | Δ |
| Comp. Ex. 6 | 4 | 43 | 2.0 | 30–50 | 5.6 | 4.5 | 3.0 | X |
| Comp. Ex. 7 | 5 | 73 | 2.0 | 30–45 | 5.0 | 5.0 | 2.5 | X |
| Unit | | Degree | mm | Volt | lines/min | Rank | Rank | |

In the above Table,
○ . . . No problems for use in practice.
X . . . Problems for use in practice.

From the above results, the following can be understood: The image quality is changed by changing the hardness of the elastic member. As the hardness decreases, the contact with the photoconductor tends to be lowered, and there is a foreign material in the photoconductor, the uniformity of charging is apt to be impaired. In particular, the effects tend to conspicuously appear on half-tone images. When a sheet with high hardness is used as the charging member, the sheet comes into line contact with the photoconductor, so that dropping of charges is apt to occur and sheets with a hardness of 29 degree or more are apt to cause problems with half-tone images.

EXAMPLE 17 TO 19, COMPARATIVE EXAMPLE 8, 9

The active carbon fibers employed in Example 13 were pulverized to prepare active carbon fibers with target carbon fiber length values of 5 μm, 30 μm, 60 μm, 80 μm, and 100 μm, and the respective active carbon fibers were dispersed in an acrylic resin, and charging member were formed into a sheet with a thickness of 0.3 mm. By use of each of these charging members, a charging apparatus was constructed in the same manner as in Example 13 and the effects thereof were evaluated. The results are shown in TABLE 5.

In the above, the contact charging apparatus is explained in detail. The charging apparatus of the present invention can also be used for non-contact charging. For use in non-contact charging, it is preferable to use fibers with a fiber length of 1 to 10 mm in the shape of a felt, a web, a paper or the like. The charging is conducted with the charging member set at an appropriate distance from the surface of the photoconductor, for instance, by performing discharging with a space of 10 to 800 μm.

TABLE 5

| | Sample Length (μm) | Charging Characteristics Ripple Potential | Image Quality Resolution | Sharpness | Half-tone Image | Judgment |
|---|---|---|---|---|---|---|
| Ex. 17 | 30 | 10 | 5.0–5.6 | 4.5 | 4.5 | ○ |
| Ex. 18 | 60 | 10–15 | 5.0–5.6 | 4.5 | 4.5 | ○ |
| Ex. 19 | 80 | 15–25 | 4.5–5.0 | 4.5 | 4.0 | ○ |
| Comp. Ex. 8 | 5 | 90–120 | 4.0–5.0 | 4.0 | 1.5 | X |
| Comp. Ex. 9 | 120 | 40–70 | 4.0–5.0 | 4.0 | 3.5 | X |
| Note | Unit | Volt | lines/mm | Rank | Rank | |

In the above Table,
○ . . . No problems for use in practice.
X . . . Problems for use in practice.

What is claimed is:

1. A charging apparatus for charging a photoconductor, comprising:

an electroconductive charging member; and means for applying a voltage to said charging member, said charging member comprising a contact surface that is configured to contact said photoconductor and adsorb ozone, wherein said charging member has micro pores with a diameter of about 10 Å to about 40 Å.

2. The charging apparatus as claimed in claim 1, wherein said charging member comprises inorganic fibers dispersed in a binder.

3. The charging apparatus as claimed in claim 2, wherein a content of said inorganic fibers is 60 to 90 wt. %.

4. The charging apparatus as claimed in claim 2, wherein said inorganic fibers have a fiber length of 5 to 120 μm.

5. The charging member as claimed in claim 2, wherein said inorganic fibers are carbon fibers.

6. The charging apparatus as claimed in claim 5, wherein said carbon fibers comprise nitrogen in an amount of 0.3 to 0.7 wt. % with respect to carbon.

7. The charging apparatus as claimed in claim 1, wherein said charging member has a web of inorganic fibers.

8. The charging apparatus as claimed in claim 7, where said web has a fray-preventing portion with a width of 1 mm or more along each of opposite side edges thereof.

9. The charging apparatus as claimed in claim 8, further comprising a fixing member configured to cover said web along each of the opposite side edges thereof over entire length thereof.

10. The charging member as claimed in claim 7, wherein said inorganic fibers are carbon fibers.

11. A charging apparatus for charging a photoconductor, comprising:

an electroconductive charging member; and means for applying a voltage to said charging member, said charging member comprising a contact surface that is configured to contact said photoconductor and adsorb ozone, wherein said charging member has a web of inorganic fibers in a blade shape, with an elastic core material being wrapped therein, supported by a holder.

12. The charging apparatus as claimed in claim 11, wherein said voltage application means comprises a voltage feed source and a resistor with a resistance of 50 MΩ or less interposed between said charging member and said voltage feed source.

13. A charging apparatus for charging a photoconductor, comprising:

an electroconductive charging member; and means for applying a voltage to said charging member, said charging member comprising a contact surface that is configured to contact said photoconductor and adsorb ozone, wherein said charging member has a web of inorganic fibers provided around a rotatable shaft via an elastic core material, said rotatable shaft configured to rotate around an axis thereof so as to change an angular position thereof.

14. The charging apparatus as claimed in claim 13, wherein said voltage application means comprises a voltage feed source and a resistor with a resistance of 50 MΩ or less interposed between said charging member and said voltage feed source.

15. A charging apparatus for charging a photoconductor, comprising:

an electroconductive charging member; and means for applying a voltage to said charging member, said charging member comprising a contact surface that is configured to contact said photoconductor and adsorb ozone, wherein said charging member is provided around a rotary shaft, said charging member being disposed about said rotary shaft in at least one of a direct configuration and another configuration with an added elastic member, and includes a layer composed of a binder and at least one of electroconductive finely-divided particles and fibers dispersed in said binder, said means for applying a voltage comprises a voltage feed source and a resistor with a resistance of 100 MΩ or less interposed between said charging member and said voltage feed source.

* * * * *